US008260171B2

(12) United States Patent
Matsuda

(10) Patent No.: US 8,260,171 B2
(45) Date of Patent: Sep. 4, 2012

(54) ELECTROPHOTOGRAPHIC IMAGE FORMING APPARATUS

(75) Inventor: Kenji Matsuda, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 117 days.

(21) Appl. No.: 12/536,908

(22) Filed: Aug. 6, 2009

(65) Prior Publication Data

US 2010/0080624 A1 Apr. 1, 2010

(30) Foreign Application Priority Data

Sep. 29, 2008 (JP) ..... 2008-250447
Apr. 22, 2009 (JP) ..... 2009-104387

(51) Int. Cl.
*G03G 15/01* (2006.01)

(52) U.S. Cl. ..... 399/110

(58) Field of Classification Search ..... 399/110
See application file for complete search history.

(56) References Cited

U.S. PATENT DOCUMENTS

| | | | | |
|---|---|---|---|---|
| 5,528,341 | A | 6/1996 | Shishido et al. | 355/200 |
| 5,642,187 | A | 6/1997 | Nomura et al. | 399/111 |
| 5,650,841 | A | 7/1997 | Matsuda et al. | 399/111 |
| 5,678,139 | A | 10/1997 | Nomura et al. | 399/114 |
| 5,697,022 | A | 12/1997 | Matsuda et al. | 399/102 |
| 5,825,472 | A | 10/1998 | Araki et al. | 355/200 |
| 5,867,751 | A | 2/1999 | Nomura et al. | 399/90 |
| 6,016,408 | A | 1/2000 | Hashimoto et al. | 399/27 |
| 6,101,352 | A | 8/2000 | Hashimoto et al. | 399/119 |
| 6,151,459 | A | 11/2000 | Hashimoto et al. | 399/27 |
| 6,272,300 | B1 | 8/2001 | Fujiwara et al. | 399/113 |
| 6,324,370 | B1 | 11/2001 | Isobe et al. | 399/258 |
| 6,564,029 | B2 | 5/2003 | Kojima et al. | 399/258 |
| 6,873,815 | B2 | 3/2005 | Matsuda et al. | 399/260 |
| 6,968,147 | B2 | 11/2005 | Matsuda et al. | 399/258 |
| 6,980,755 | B2 | 12/2005 | Numagami et al. | 399/109 |
| 7,200,350 | B2 | 4/2007 | Agata et al. | 399/223 |
| 7,274,894 | B2 | 9/2007 | Sato et al. | |

(Continued)

FOREIGN PATENT DOCUMENTS

JP 9-152757 6/1997

(Continued)

OTHER PUBLICATIONS

Japanese Office Action dated Mar. 30, 2010, in Japanese Application No. 2009-104387, and English-language translation thereof.

(Continued)

*Primary Examiner* — Constantine Hannaher
(74) *Attorney, Agent, or Firm* — Fitzpatrick, Cella, Harper & Scinto

(57) ABSTRACT

An electrophotographic image forming apparatus for forming an image on a recording material, the electrophotographic image forming apparatus includes a drum cartridge including an electrophotographic photosensitive member drum; a developing cartridge including a developing roller for developing an electrostatic latent image formed on the electrophotographic photosensitive drum using a developer; a supporting member movable between an inside position and a retracted position in the state that supporting member supports the drum cartridge and the developing cartridge, wherein the inside position is inside the main assembly of the apparatus, and the retracted position is retracted from the main assembly of the apparatus; wherein the supporting member supports the drum cartridge and the developing cartridge independently demountably therefrom, wherein mounting and demounting directions of the drum cartridge relative to the supporting member and mounting and demounting directions of the developing cartridge are different from each other.

10 Claims, 21 Drawing Sheets

U.S. PATENT DOCUMENTS

| | | | | |
|---|---|---|---|---|
| 7,277,659 | B2 | 10/2007 | Kobayashi et al. | 399/106 |
| 7,395,008 | B2 | 7/2008 | Sato et al. | |
| 7,415,223 | B2 | 8/2008 | Sato et al. | |
| 7,447,467 | B2 | 11/2008 | Kamimura et al. | |
| 7,486,909 | B2 | 2/2009 | Sato et al. | |
| 7,489,889 | B2 | 2/2009 | Sato et al. | |
| 7,593,670 | B2 | 9/2009 | Matsuda et al. | 399/174 |
| 7,715,756 | B2 | 5/2010 | Hattori | |
| 7,720,413 | B2 | 5/2010 | Kamimura et al. | |
| 2004/0165910 | A1 | 8/2004 | Sato et al. | |
| 2006/0140673 | A1 | 6/2006 | Kamimura et al. | |
| 2006/0153589 | A1 | 7/2006 | Sato et al. | |
| 2007/0147881 | A1 | 6/2007 | Okabe et al. | 399/110 |
| 2007/0147887 | A1 | 6/2007 | Hattori | |
| 2007/0160386 | A1* | 7/2007 | Kawamura | 399/110 |
| 2008/0019731 | A1 | 1/2008 | Sato et al. | |
| 2008/0019732 | A1 | 1/2008 | Sato et al. | |
| 2008/0170875 | A1* | 7/2008 | Kim et al. | 399/90 |
| 2008/0232852 | A1 | 9/2008 | Sato et al. | |
| 2009/0028602 | A1 | 1/2009 | Kamimura et al. | |

FOREIGN PATENT DOCUMENTS

| | | |
|---|---|---|
| JP | 2004-109455 | 4/2004 |
| JP | 2004-279480 | 10/2004 |
| JP | 2004-279937 | 10/2004 |
| JP | 2006-184552 | 7/2006 |
| JP | 2007-178656 | 7/2007 |

OTHER PUBLICATIONS

Japanese Office Action dated Nov. 4, 2009, in Japanese Application No. 2009-104387, and English-language translation thereof.

* cited by examiner (a)

(b)

(a)

(b)

(a)

(b)

ELECTROPHOTOGRAPHIC IMAGE FORMING APPARATUS

FIELD OF THE INVENTION AND RELATED ART

The present invention relates to an electrophotographic image forming apparatus, which is structured so that a drum cartridge and a development cartridge are removably mountable in the main assembly of the image forming apparatus, and also, so that it forms an image on recording medium while the drum cartridge and development cartridge remain in the main assembly of the image forming apparatus. Here, an electrophotographic image forming apparatus means an apparatus which forms a color image on recording medium, with the use of an electrophotographic image formation process. As examples of an electrophotographic image forming apparatus, an electrophotographic copying machine, an electrophotographic printer (for example, color laser beam printer, color LED printer, etc.), a facsimile apparatus, a word processor, etc., can be included.

There have been known electrophotographic color image forming apparatuses (which hereafter will be referred to simply as image forming apparatuses) which form a color image on recording medium. In the case of a conventional electrophotographic color image forming apparatus, two or more electrophotographic photosensitive drums (which hereafter will be referred to as photosensitive drums) are disposed in parallel, and two or more development rollers are disposed so that they oppose the photosensitive drums, one for one, and also, so that each of the electrostatic latent images formed on the photosensitive drums, one for one, is developed with a developer which is different in color from the developer used for developing the other electrostatic latent images. Incidentally, disposing two or more photosensitive drums in parallel is generally referred to as a tandem arrangement.

There have been known structural arrangements which allow multiple development cartridges having a development roller, to be removably mounted in the main assembly of an image forming apparatus of the tandem type, in such a manner that the development rollers oppose the photosensitive drums one for one (disclosed in U.S. Patent Application 0147881/2007, for example).

However, the multiple photosensitive drums become different in the length of their service lives, because the frequency with which each of the developers different in color is used is different from the frequency with which the other developers are used, and also, the amount by which each developer is used is different from the amount by which the other developers are used. Thus, it is desired that an electrophotographic color image forming apparatus is structured so that each photosensitive drum can be independently replaced from the other photosensitive drums.

SUMMARY OF THE INVENTION

Thus, the primary object of the present invention is to provide an electrophotographic image forming apparatus structured so that each of the drum cartridges and development cartridges for the image forming apparatus can be independently mounted onto, or removed from, the drum cartridge supporting member and development cartridge supporting member of the apparatus, respectively, independently from the other drum cartridges and development cartridges.

Here, the drum cartridge mentioned above is a cartridge having an electrophotographic photosensitive drum. The development cartridge mentioned above is a cartridge having a development roller for developing an electrostatic latent image formed on the corresponding electrophotographic photosensitive drum, with the use of developer. Further, the supporting member is a member of the main assembly of the image forming apparatus, which moves between its innermost position in the main assembly of the electrophotographic image forming apparatus, and its outermost position, or its outside position, in which the supporting member is when it is outside the main assembly 1.

Another object of the present invention is to provide an electrophotographic image forming apparatus which is superior to a conventional electrophotographic image forming apparatus, in terms of the operational efficiency with which the drum cartridges and development cartridges can be replaced.

Another object of the present invention is to provide an electrophotographic image forming apparatus structured so that the direction in which the drum cartridges are mounted onto, or removed from, the supporting member is different from the direction in which the development cartridges are mounted into, or removed from, the supporting member.

According to an aspect of the present invention, there is provided a An electrophotographic image forming apparatus for forming an image on a recording material, said electrophotographic image forming apparatus comprising a drum cartridge including an electrophotographic photosensitive member drum; a developing cartridge including a developing roller for developing an electrostatic latent image formed on said electrophotographic photosensitive drum using a developer; a supporting member movable between an inside position and a retracted position in the state that supporting member supports said drum cartridge and said developing cartridge, wherein the inside position is inside said main assembly of said apparatus, and the retracted position is retracted from said main assembly of said apparatus; wherein said supporting member supports said drum cartridge and said developing cartridge independently demountably therefrom, wherein mounting and demounting directions of said drum cartridge relative to said supporting member and mounting and demounting directions of said developing cartridge are different from each other.

As described above, according to the present invention, each of the drum cartridges and development cartridges can be removed from the supporting member, independently from the others. Further, according to the present invention, each of the drum cartridges and development cartridges can be attached to the supporting member, independently from the others.

Further, the present invention improved the operational efficiency with which the drum cartridges and development cartridges are replaced.

Further, the present invention can make the direction in which the drum cartridges are mounted onto, or removed from, their supporting member, different from the direction in which the development cartridges are mounted onto, or removed from, the supporting member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings. It should be noted here that unless specifically noted, the materials and shapes of the structural components of any of the image forming apparatuses in the following preferred embodiments of the present invention, and the positional relationship among the structural components, are not intended to limit the present invention in scope.

Embodiment 1

First, referring to FIGS. 1-8, the electrophotographic color image forming apparatus (which hereafter will be referred to simply as image forming apparatus) in the first preferred embodiment of the present invention will be described.

<Image Forming Apparatus>

Figure 1:
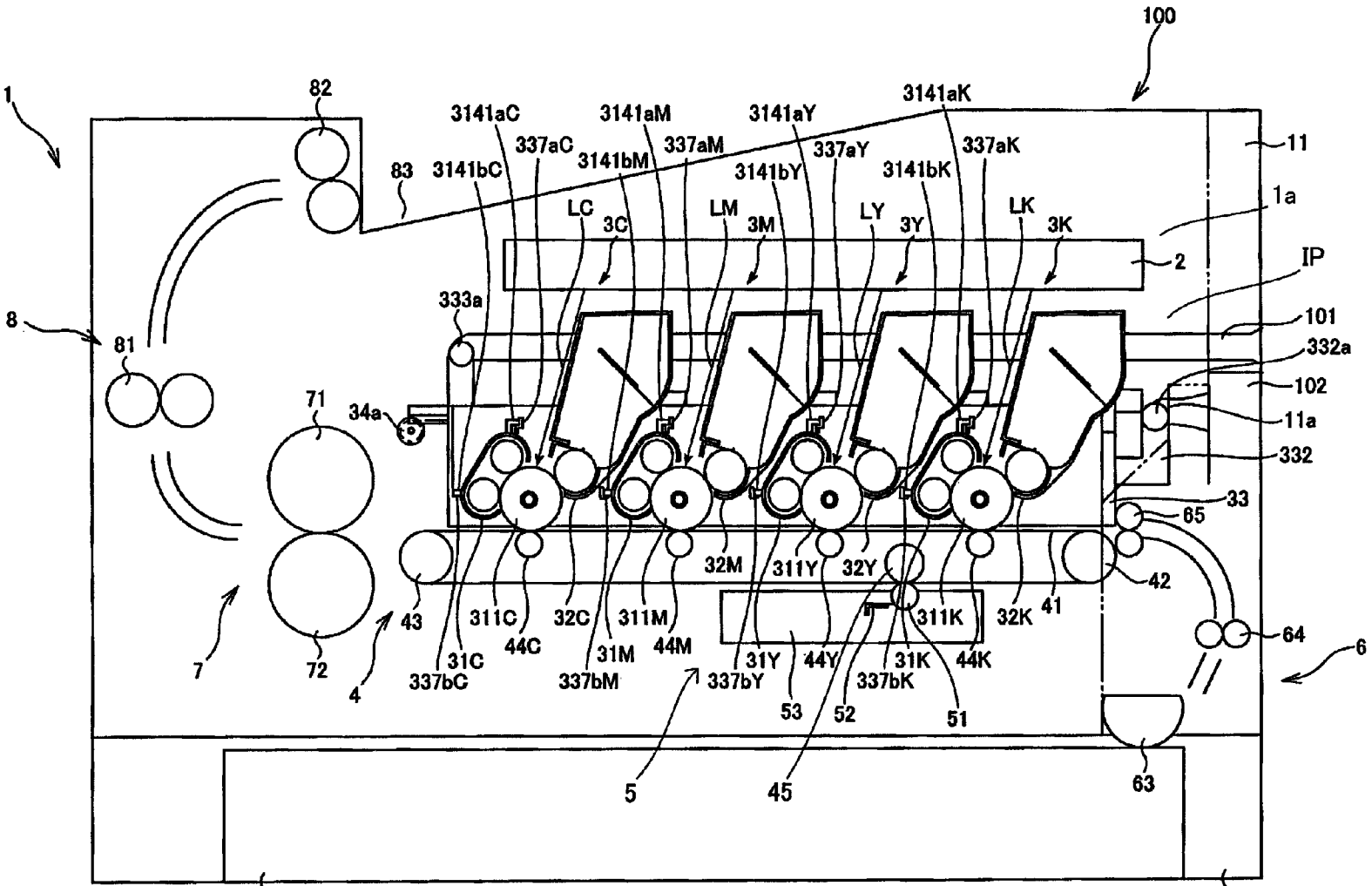
FIG. 1 is a sectional view of the image forming apparatus in the first preferred embodiment of the present invention, and shows the general structure of the apparatus.

Referring to FIG. 1, the overall structure of the image forming apparatus in the first preferred embodiment of the present invention will be described. FIG. 1 is a sectional view of the image forming apparatus in the first preferred embodiment of the present invention, and shows the general structure of the apparatus.

The main assembly 1 of the image forming apparatus 100 is provided with image forming portions 3K, 3Y, 3M, and 3C, which form black, yellow, magenta, and cyan images, respectively. The image forming portions are disposed in parallel. Hereafter, the suffix of each of the referential codes 3K, 3Y, 3M, and 3C, which indicates the color of the images formed by the image forming portions, may be left out; each of the image forming portions 3K, 3Y, 3M, and 3C may be referred to simply as "image forming portion 3". So may be the suffix of each of the referential codes of the various components of the image forming apparatus.

FIG. 1 shows the state of the image forming apparatus when the tray unit 33 (supporting member), which will be described later, is in its preset innermost position, and the drum cartridges 31 and development cartridge 32 are ready for image formation. The main assembly 1 is what remains after the drum cartridges 31 and development cartridges 31 are removed from the image forming apparatus 100.

The image forming portions 3K, 3Y, 3M, and 3C are provided with electrophotographic photosensitive drums 311K, 311Y, 311M, and 311C, which are for bearing black, yellow, magenta, and cyan images, respectively.

The main assembly 1 is also provided with a laser unit 2, which is above these image forming portions 3. The laser unit 2 projects beams of laser light LK, LY, LM, and LC upon the photosensitive drums 311K, 311Y, 311M, and 311C with which the image forming portions 3K, 3Y, 3M, and 3C are provided, respectively. As the beam of laser light is projected upon the photosensitive drum 311, an electrostatic latent image is formed, which reflects the information of the image to be formed. Hereafter, the suffixial letters K, Y, M, and C, which indicate the color of the laser beam, may be left out; each of the four beams of laser light may be referred to simply as beam L of laser light.

Further, the main assembly 1 is provided with a transfer unit 4, which is below the combination of the four image forming portions 3. The transfer unit 4 transfers onto a sheet 61 of recording medium, an image formed of developer on photosensitive drum 311. Here, recording medium is medium on which an image is formed with the use of an electrophotographic image formation process. As the concrete examples of the sheet 61 of recording medium, a sheet of paper, an OHP sheet, a piece of fabric, etc., can be listed.

The main assembly 1 is also provided with a recover unit 5, which is located below the combination of the image forming portions 3. The recover unit 5 recovers the developer t, which remained adhered to a transfer belt 41 of the unit 4 after the transfer of the image formed of developer. Further, the main assembly 1 is provided with a cassette 6, which is below the unit 5. The cassette 6 is where multiple sheets 61 of recording medium are stored in layers.

Further, the main assembly 1 is provided with a fixation unit 7 for fixing the developer image to the sheet 61 after the transfer of the developer image onto the sheet 61. The fixation unit 7 is on the left side (in drawing) of the combination of the image forming portions 3. Further, the main assembly 1 is provided with a discharging portion 8 for discharging the sheet 61 out of the main assembly 1 after the fixation of the developer image to the sheet 61. The discharging portion 8 is above the unit 7.

Further, the main assembly 1 is provided with a conveying portion 6, which is on the right side (in drawing) of the unit 4.

<Conveying Portion>

Next, referring to FIG. 1, the conveying portion 6 will be described in more detail. The conveying portion 6 is for conveying the sheet 61 to the unit 4. It has a feed roller 63, a pair of conveyance rollers 64, a pair of registration rollers 65, etc., in addition to the abovementioned cassette 61.

The roller 63 feeds the sheets 61 in the cassette 62, into the main assembly 1, one by one, by rotating as an image forming operation continues. After being fed out into the main assembly 1 by the roller 63, each sheet 61 is conveyed by the pair of rollers 64 to the pair of roller 65, which is located further downstream.

The moment the leading edge of the sheet 61 arrives at the nip between the pair of rollers 65, the pair of rollers 65 is stationary. Thus, if the sheet 61 happens to be askew as it arrives at the nip, it is straightened by the pair of the rollers 65 (nip), which is remaining stationary. Thereafter, the rotation of the pair of rollers 65 is started with preset timing so that the developer image can transferred onto the sheet 61, across the preset portion of the sheet 61. Thus, the sheet 61 is conveyed to the transfer unit 4.

<Image Forming Portion>

Figure 2:
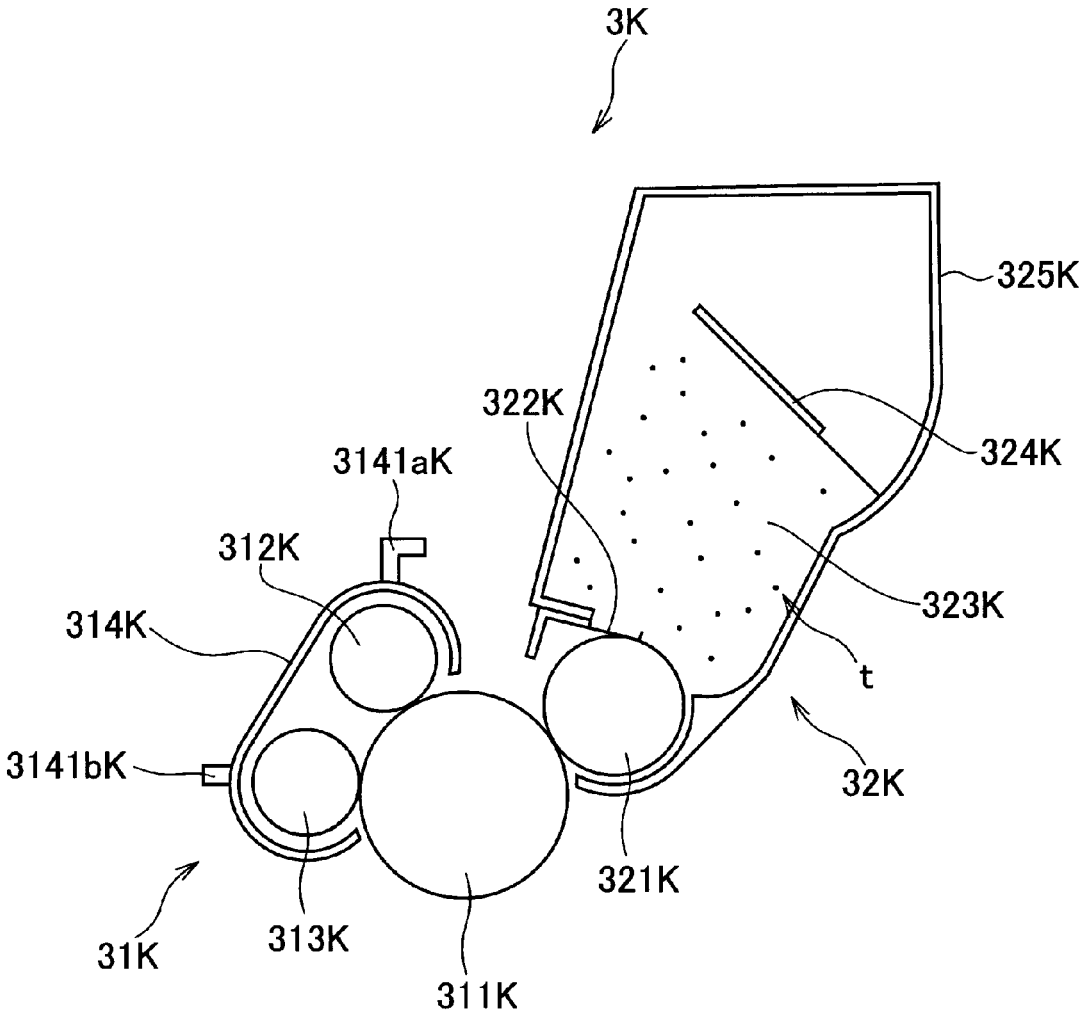
FIG. 2 is a cross-sectional view of the image forming portion of the image forming apparatus in FIG. 1, and shows the structure of the image forming portion.

Next, referring to FIG. 2, the image forming portion 3 will be described in more detail. FIG. 2 is a sectional view of one of the image forming portions 3 of the image forming apparatus 100 in this embodiment, and shows the structure of the image forming portion 3.

As described above, the image forming apparatus 100 is provided with the four image forming portions 3 (3K, 3Y, 3M, and 3C) which form black, yellow, magenta and cyan images, respectively. The four image forming portions 3 are the same in basic structure, although they are different in the color of the developer t they use. Thus, FIG. 2 shows the image forming portion 3K, which forms a black image, as the image forming portion which represents the four image forming portions 3.

The image forming portion 3 is provided with a charge roller 312 (312K, 312Y, 312M, or 312C), as a charging means (processing means), in addition to the photosensitive drum 311. Hereafter, the suffixial letters K, Y, M, and C, which indicate the color with which the four charge rollers 312K, 312Y, 312M, and 312C are associated may be left out; each of the charge rollers may be referred to simply as a charge roller 312. The same holds true in the case of the components of the image forming apparatus 100, other than the abovementioned components.

The four image forming portions 3K, 3Y, 3M, and 3C are structured so that the development cartridges 32K, 32Y, 32M, and 32C having the development rollers 321K, 321Y, 321M, and 321C, which are developing means (processing means), are removably attachable in the image forming portions 3K, 3Y, 3M, and 3C, respectively.

Further, the four image forming portions 3K, 3Y, 3M, and 3C are provided with cleaning rollers 313K, 313Y, 313M, and 313C, respectively, which are cleaning means (processing means).

Next, the image formation process which is carried out by each image forming portion 3 will be described.

Each photosensitive drum 311 is cylindrical. It has a cylindrical substrate, and photosensitive layers which cover the peripheral surface of the cylindrical substrate. The photosensitive layers are formed of organic photosensitive substances. The photosensitive drum 311 is rotatably supported. It rotates in the clockwise direction (FIG. 2) when the image forming apparatus 100 forms an image.

The charge roller 312 is a roller for charging the photosensitive drum 311. As charge bias is applied to the charge roller 312 from a bias charging means (unshown), the charge roller 312 uniformly charges the peripheral surface of the photosensitive drum 311.

After the charging of the peripheral surface of the photosensitive drum 311, a beam L of laser light is projected by a laser unit 2 upon the charged peripheral surface of the photosensitive drum 311, while being modulated with the information regarding the image to be formed, as described above, whereby an electrostatic latent image is effected on the peripheral surface of the photosensitive drum 311.

The development cartridges 32K, 32Y, 32M, and 32C have development rollers 321K, 321Y, 321M, and 321C, respectively, which bear developer t.

The cartridges 32K, 32Y, 32M, and 32C have also development blades 322K, 322Y, 322M, and 322C, respectively, which regulate in thickness the layer of developer t having adhered to the development roller 321, and also, charge the developer t.

Further, the cartridges 32K, 32Y, 32M, and 32C have developer storage portions 323K, 323Y, 323M, and 323C, respectively, which store the developer t. The cartridge 32K has a developer storage portion 323K, which stores black developer t. It forms a black developer image on the drum 311K. The cartridge 32Y has a storage portion 323Y, which stores yellow developer t. It forms a yellow developer image on the drum 311Y. The cartridge 32M has a storage portion 323M, in which magenta developer t is stored. It forms a magenta developer image on the drum 311M. The cartridge 32C has a storage portion 323C in which cyan developer t is stored. It forms an image of cyan color, on the drum 311C.

Further, the cartridges 32K, 32Y, 32M, and 32C have stirring members 324K, 324Y, 324M, and 324C, which convey the developer t to the development rollers 321K, 321Y, 321M, and 321C while stirring the developer t in the developer storage portions 323K, 323Y, 323M, and 323C, respectively.

During an image forming operation, each development roller 321 rotates in the counterclockwise direction (FIG. 2). As the developer t borne on the peripheral surface of the development roller 321 is moved past the development blade 322 while remaining in contact with the development blade 322, the developer t becomes charged. Thus, as the development roller 321 is rotated further, the charged developer t is adhered to the electrostatic latent image (which has just been formed on photosensitive drum 311) by the development bias applied to the development roller 321 by the bias applying means (unshown), in the area in which the development roller 321 opposes the photosensitive drum 311. In other words, the electrostatic latent image is developed by the combination of the development roller 321 and the developer t on the development roller 321.

After the formation of a developer image (development of electrostatic latent image) on the photosensitive drum 311 by the cartridge 32, the developer image is transferred onto the sheet 61 (of recording medium), which is on a transfer belt 41 and being conveyed by the transfer belt 41 (FIG. 1). The developer t, which is remaining on the photosensitive drum 311 after the transfer, that is, the developer t, which failed to be transferred from the photosensitive drum 311 onto the sheet 61, is recovered by a cleaning roller 313.

As the above described steps of the electrostatic image formation process are repeated by the image forming portion 3, the intended image is completed (formed) on the sheet 61.

As for the developer t recovered by the cleaning roller 313, it is adhered to the photosensitive drum 311 with a preset timing, and then, is recovered into a recovery unit 5 by way of the belt 41.

Incidentally, the method for recovering the residual developer t on the photosensitive drum 311, that is, the portion of the developer image on the photosensitive drum 311, which failed to be transferred onto the sheet 61, does not need to be limited to the above described one. That is, any of the known methods, for example, the method which uses a cleaning blade, may be used as needed.

<Transfer Unit>

Next, referring to FIG. 1, the transfer unit 4 will be described.

The unit 4 has: the transfer belt 41 which conveys the sheet 61 by bonding the sheet 61 to the transfer belt 41; a belt tension roller 42, which provides the belt with tension; and a belt driving roller 43 for driving the belt 41. Further, the unit 4 has: a transfer roller 44 (44K, 44Y, 44M, and 44C) for transferring the developer image after the formation of the developer image on the photosensitive drum 311; and a roller 45 which is disposed in such a manner that it opposes the recovery roller 51 of the recovery unit 5 with the presence of the transfer belt 41 between the two rollers 45 and 51.

The belt 41 adheres the sheet 61 to itself so that it can reliably convey the sheet 61. As the sheet 61 is conveyed by the belt 41, it sequentially moves through the four nips formed by the four photosensitive drums 311 and corresponding transfer rollers 44, one for one. While the sheet 61 is moved through each nip, a preset transfer bias is applied to the transfer roller 44 by a bias applying means (unshown). Thus, the four developer images on the four photosensitive drums 311, one for one, are sequentially transferred onto the sheet 61, effecting thereby a color image (developer image) on the sheet 61.

The roller 43 is the roller for rotating the belt 41, and is rotated by a driving means (unshown) in the counterclockwise direction (FIG. 1). The roller 45 is positioned so that it is pressed against the roller 51 with the presence of the belt 41 between the two rollers 45 and 51. Thus, the belt 41 is kept pinched in the nip which the two rollers 45 and 51 form. The roller 42 provides the belt 41 with a preset amount of tension, by being aided by a pressure applying means (unshown).

<Recovery Unit>

Next, referring to FIG. 1, the recovery unit 5 will be described.

The unit 5 has: the recovery roller 51 for scraping away the residues on the belt 41; a scraper 52 for scraping down the residues recovered by the roller 51; and a recovery container 53.

There are such residues as the residue from the developer t adhered to the belt 41 by the roller 313 as described above, and paper dust, on the belt 41. The roller 51 is rotated by a driving means (unshown), and a preset bias is applied to the roller 51 by a bias applying means (unshown), so that these residues are recovered by the roller 51.

The scraper 52 is made up of a piece of flexible sheet. One of its lengthwise edges is in contact with the roller 51. With the provision of this structural arrangement, the residues recovered by the roller 51 are scraped down from the peripheral surface of the roller 51 by the scraper 52, and are recovered into the container 53.

<Fixation Unit>

Next, referring to FIG. 1, the fixation unit 7 will be described.

The fixation unit 7 has a heat roller 71 and a pressure roller 72. The roller 71 has a heating means (unshown), which is inside the roller 71. It is heated to a preset temperature level. The pressure roller 72 is kept pressed upon the roller 71 by a pressing means (unshown) so that a preset amount of pressure is maintained between the two rollers 71 and 72.

While the sheet 61, which is bearing the developer image transferred onto the sheet 61 by the transfer unit 4, is conveyed through the nip portion between the rollers 71 and 72, heat and pressure is applied to the sheet 61 and the developer image thereon, whereby the developer image becomes fixed to the sheet 61, yielding thereby the sheet 61 bearing a fixed developer image.

<Discharge Portion>

Next, referring to FIG. 1, the discharge portion 8 will be described.

The discharge portion 8 has a pair of conveyance rollers 81, a pair of discharge rollers 82, and a delivery portion 83 (tray).

After the fixation of the developer image to the sheet 61, the sheet 61 is conveyed out of the fixation unit 7, and then, is conveyed to the discharge portion 8.

The rollers 81 are for conveying the sheet 61 to the pair of rollers 82, and are rotated, along with the rollers 82, by a driving means (unshown). The rollers 82 are for discharging the sheet 61 out of the main assembly 1. The delivery portion 83 is the portion into which the sheet 61 is discharged in such a manner that it will be placed on top of the preceding sheet 61, after the fixation of the developer image to the sheet 61, that is, after the completion of the image on the sheet 61.

<Unitization of Components with Limited Service Life, and Consumables (Placement of Components with Limited Service life, and Consumables, in Cartridge)>

Next, the unitization of components with a limited service life, and consumables, will be described.

As described above, each image forming portion 3 of the image forming apparatus 100 in this embodiment is provided with the photosensitive drum 311, charge roller 312, cleaning roller 313, and development roller 321.

Some of the various members (components), which make up the image forming portion 3, wear out. Thus, they have to be replaced as they reach the end of their service life. Here, the end of their service life refers to when they reach the point beyond which they become unsatisfactory for the image forming apparatus to continue to form images satisfactory in quality to a user, because of their deterioration and/or wear.

In this embodiment, therefore, the components which are likely to wear and/or deteriorate, are placed together in a cartridge to make simpler the operation for replacing them. More concretely, each image forming portion is made up of a drum cartridge 31 (31K, 31Y, 31M, and 31C) and the development cartridge 32 (32K, 32Y, 32M, and 32C) described above. The cartridge 31K and 32K are paired to form an image forming portion, and so are the cartridges 31Y and 32Y, cartridges 31M and 32M, and cartridges 31C and 32C.

The cartridge 31 has the photosensitive drum 311, charge roller 312 (charging means), and cleaning roller 313 (cleaning means), which were unitized. The development cartridge 32 has the development roller 321 (developing means) and developer storage portion 323, which were unitized.

If any of the cartridges 31 and 32 reaches the end of its service life, a user can replace the cartridge(s) having reached the end of its service life, with a brand-new one to ensure that the image forming apparatus 100 continues to form high quality images.

<Drum Cartridge>

Figure 3:
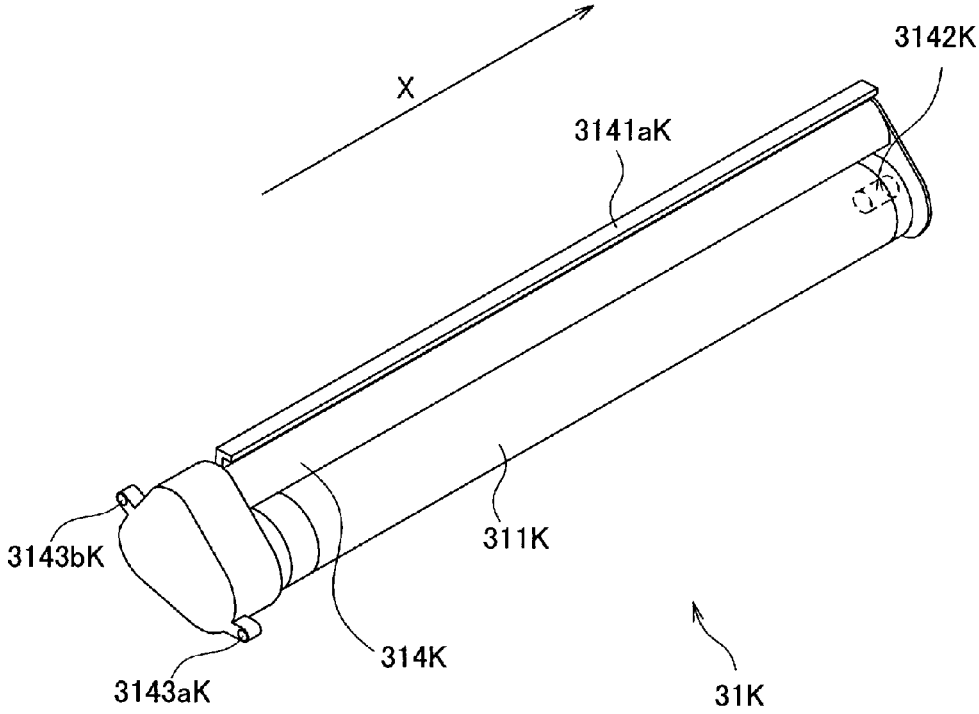
FIG. 3 is perspective views of one of the drum cartridges, and one of the development cartridges, respectively, in the first preferred embodiment.
Figure 3:
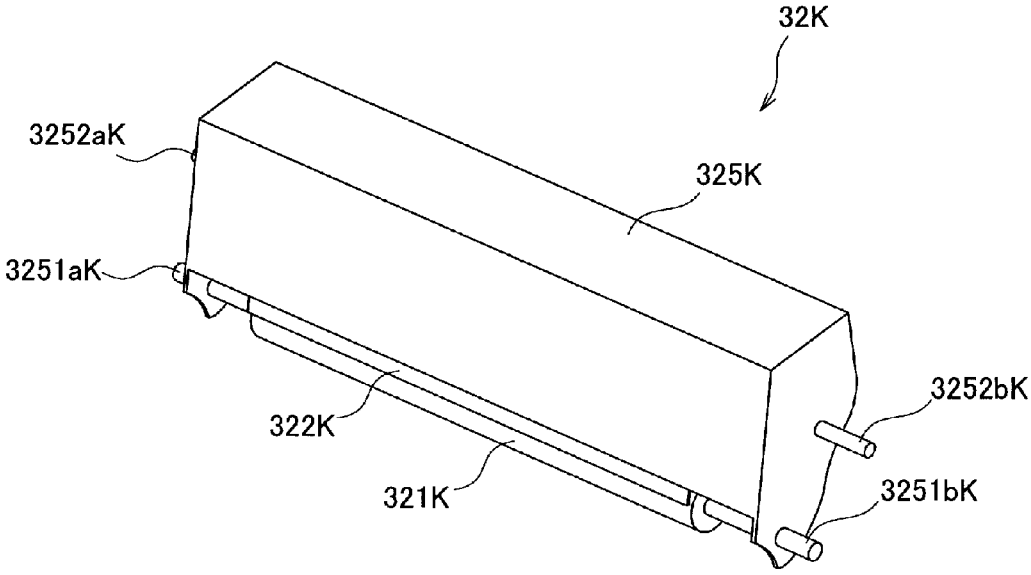

Next, referring to FIGS. 2 and 3(*a*), the drum cartridge 31 will be described. FIG. 3(*a*) is a perspective view of the drum cartridge 31 in the first preferred embodiment of the present invention. As described above, the four image forming portions 3 (3K, 3Y, 3M, and 3C) are basically the same in structure, although they are different in the color of the developer t. Therefore, shown in FIG. 3(*a*) is the drum cartridge 31K, as the cartridge which represents all the cartridges 31, as it does in FIG. 2.

The cartridge 31 has the photosensitive drum 311, charge roller 312, cleaning roller 313, and the drum cartridge frame 314 (314K, 314Y, 314M, and 314C) to which the preceding three components are attached to unitize them.

Further, the frame 314 is provided with: a drum cartridge guide 3141*a* (3141*a*K, 3141*a*Y, 3141*a*M, and 3141*a*C) (guiding members, by which frame 314 is guided) which guides the cartridge 31 when the cartridge 31 is mounted into, or removed from the main assembly 1; a drum cartridge guide 3141*b* (3141*b*K, 3141*b*Y, 3141*b*M, and 3141*b*C) (guiding members, by which frame 314 is guided) which guides the cartridge 31 when the cartridge 31 is mounted into, or removed from the main assembly 1 (FIGS. 2 and 3(*a*)). The guides 3141*a* and 3141*b* (guiding members by which frame 314 is guided) are parallel to the lengthwise direction of the cartridge 31 (axial line of photosensitive drum 311). Further, they are different in the direction in which they outwardly protrude from the frame 314 (FIG. 2).

The frame 314 is also provided with: a drum cartridge positioning front hole 3143*a* (3143*a*K, 3143*a*Y, 3143*a*M, and 3143*a*C) (positioning hole by which frame 314 is positioned) which precisely positions the cartridge 31 relative to the unit 33; and a drum cartridge positioning front hole 3143*b* (3143*b*K, 3143*b*Y, 3143*b*M, and 3143*b*C) (positioning hole, by which frame 314 is positioned) which precisely positions the cartridge 31 relative to the unit 33 (FIG. 3(*a*)). The positioning holes 3143*a* and 3143*b* are portions of protrusions, one for one, protruding from the trailing end of the frame 314 (in terms of the direction indicated by arrow mark X, that is, the direction in which the cartridge 31 is inserted into the unit 33), in the direction intersectional (perpendicular) to the cartridge insertion direction X.

Further, the frame 314 is provided with a drum cartridge positioning front hole (groove) 3142 (3142K, 3142Y, 3142M, and 3142C) (positioning members, by frame 314 (cartridge 31) is guided) which precisely positions the cartridge 31 relative to the unit 33. The positioning hole 3142 is at the leading end of the frame 314 in terms of the direction X in which the cartridge 31 is inserted into the unit 33, and its axial line coincides with that of the photosensitive drum 311. That is, the leading end of the cartridge 31, in terms of the cartridge insertion direction X, is precisely positioned relative to the unit 33 by the hole 3142 of the frame 314, which is at the leading end of the cartridge 31, whereas the trailing end of the cartridge 31 is precisely positioned relative to the unit 33 by the holes 3143*a* and 3143*b* of the frame 314, which is at the trailing end of the frame 314 in terms of the cartridge insertion direction X. As described above, the axial line of the hole 3142 coincides with the axial line of the photosensitive drum 311. Therefore, as the cartridge 31 is precisely positioned relative to the unit 33, the photosensitive drum 311 is also precisely positioned relative to the unit 33. Incidentally, the axial lines of the 3142, 3143*a*, and 3143*b* are parallel to the cartridge insertion direction X. Also as described above, the photosensitive drum 311, charge roller 312, and cleaning roller 313 are integral parts of the cartridge 31, and therefore, removably mounted in the main assembly 1.

The cartridge 31 integrally holds the charge roller 312 (charging means) and cleaning roller 313 (cleaning means), which are processing means, and photosensitive drum 311, and is removably mountable in the main assembly 1. Thus, the cartridge 31 may be referred to as a process cartridge, because, a process cartridge is a cartridge in which at least one of the charging means and cleaning means, which are processing means, and the photosensitive drum, are integrally disposed so that they can be removably mounted in the main assembly 1 of the image forming apparatus 100. Incidentally, this embodiment is not intended to limit the present invention in terms of the structure of the cartridge 31. For example, what is required of the cartridge 31 is that it has at least the photosensitive drum 311, and is removably mountable in the main assembly 1. It is possible that the cartridge 31 has only the photosensitive drum 311, that is, it does not have any of the aforementioned processing means. In such a case, the charge roller 312 (charging means) and cleaning roller 313 (cleaning means) are to be attached to the main assembly 1.

<Development Cartridge>

Next, referring to FIGS. 2 and 3(*b*), the development cartridge 32 will be described in more detail. FIG. 3(*b*) is a perspective view of the cartridge 32 in the first preferred embodiment of the present invention.

The cartridge 32 has the development roller 321, development blade 322, stirring member 324, and a development cartridge frame 325 (325K, 325Y, 325M, and 325C) to which the preceding components are attached to be unitized. The development cartridge frame 325 has a development storage portion 323. That is, the cartridge 32 is an integration of the development roller 321, development blade 322, stirring member 324, and developer storage portion 323, and is removably mountable in the main assembly 1.

The frame 325 is provided with a pair of developer cartridge positioning shafts 3251*a* (3251*a*K, 3251*a*Y, 3251*a*M, and 3251*a*C) and 3251*b* (3251*b*K, 3251*b*Y, 3251*b*M, and 3251*b*C), which are positioning portions for precisely positioning the cartridge 32 relative to the unit 33. More specifically, the positioning shaft 3251*a* projects from one of the lengthwise ends of the cartridge 32 (direction parallel to axial line of development roller 321), and the positioning shaft 3251*b* projects from the other lengthwise end of the cartridge 32. The axial lines of the shafts 3251*a* and 3251*b* coincide with the axial line of the development roller 321. Thus, the cartridge 32 is precisely positioned relative to the unit 33 in such a manner that the development roller 321 is precisely positioned relative to the unit 33.

Further, the frame 325 is provided with a pair of separation bosses 3252*a* (3252*a*K, 3252*a*Y, 3252*a*M, and 3252*a*C) and 3252*b* (3252*b*K, 3252*b*Y, 3252*b*M, and 3252*b*C), which project from the lengthwise ends of the frame 325, one for one, in the direction parallel to the lengthwise direction of the frame 325. Each of the separation bosses 3252*a* and 3252*b* is one of the members which make up the means (mechanism) for placing the development roller 321 in contact with the photosensitive drum 311, or separating the development roller 321 from the photosensitive drum 311. This means for placing the development roller 321 in contact with, or separating from, the photosensitive drum 311, will be described later in more detail.

<Tray Unit System>

Figure 4:
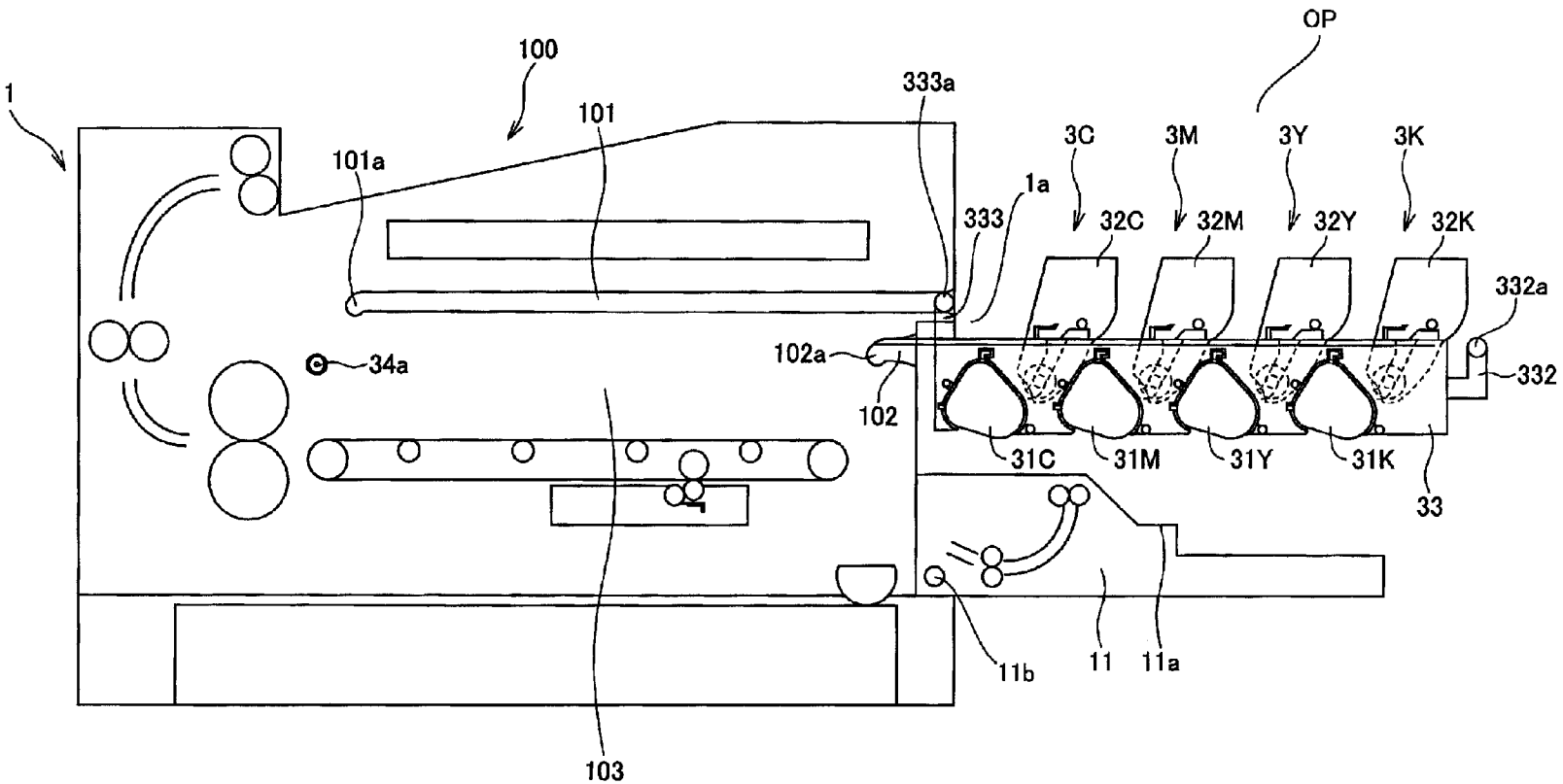
FIG. 4 is a sectional view of the image forming apparatus in the first preferred embodiment, the supporting member of which is in its outermost position relative to the main assembly of the apparatus.

Next, referring to FIGS. 1 and 4, the tray unit system will be described. FIG. 4 is a schematic sectional view of the tray unit (supporting member) 33 in the first preferred embodiment of the present invention, when the tray unit 33 is in its outermost position relative to the main assembly 1.

The image forming apparatus 100 in this embodiment is provided with the unit 33, which is a supporting member for supporting the image forming portions 3. The image forming apparatus 100 is structured so that when its main assembly 1 is on a horizontal surface, the unit 33 is horizontally movable relative to the main assembly 1. Further, the unit 33 is supported by the main assembly 1 so that it is movable between its innermost position in the main assembly 1 and its outermost position relative to the main assembly 1. If a user wants to move the unit 33 out of the main assembly 1, the user is to open the main assembly cover 11, and then, horizontally pull the unit 33 outward in a straight line, as shown in FIG. 4. Incidentally, the main assembly cover 1 is capable of taking the closed position and open position, in which it keeps the opening 1*a* of the main assembly 1 closed or open, respectively. The unit 33 is movable, while supporting the cartridges 31 and 32, between the innermost position IP (FIG. 1) in the main assembly 1, and the outermost position OP (FIG. 4) relative to the main assembly 1. Thus, when the unit 33 is moved between the innermost position IP and outermost position OP, it moves through the opening 1*a*. That is, the opening 1*a* is the opening which allows the unit 33 to move between the inward and outward side of the main assembly 1. By the way, FIG. 1 is a drawing for showing the state of the unit 33 when the unit 33 is in the innermost position IP, and FIG. 4 is a drawing for showing the state of the unit 33 when the unit 33 is in the outermost position OP. The outermost position OP is the unit position which allows a user to mount the cartridges 31 and 32 into the unit 33, or remove the cartridges 31 and 32 from the unit 32. The innermost position IP is the unit position which allows the unit 33 to keep the cartridges 31 and 32 in the image forming portions in the main assembly 1. The image forming position is the cartridge position in which the cartridges 31 and 32 contribute to the image formation process. That is, the image forming position is the position in which the cartridges 31 and 32 carry out the image formation process. In this embodiment, when the unit 33 is in its innermost position IP (image forming position), the photosensitive drum 311, which the cartridge 31 has, is in contact with the belt 41.

The unit 33 is a member (unit) for supporting multiple cartridges 31 and 32. The unit 33 and cartridge 31 and 32 are structured so that the cartridges 31 and 32 can be individually and removably mountable in the unit 33. If a user wants to replace the cartridge 31 or cartridge 32, the user is to move the unit 33 out of the main assembly 1 before the user replace the cartridge(s). That is, the user is to pull the unit 33 out of the main assembly 1 (from innermost position IP, FIG. 1), all the way to the outermost position OP (FIG. 4), and then, the user is to replace the cartridge(s) 31 and 32 which needs to be replaced, with brand-new cartridge(s) 31 and 32, while keeping the unit 33 in the outermost position OP. After the completion of the cartridge replacement operation, the user is to move the unit 33 back into the innermost position IP in the main assembly 1 by horizontally moving the unit 33 in a straight line. In other words, in this embodiment, the cartridges 31 and 32 are removably mountable in the main assembly 1. That is, the cartridges 31 and 32 are removably positioned in their image forming portions described above. Referring to FIG. 4, the main assembly 1 is provided with a pair of inner walls 103 and a pair of tray guiding rails 101 and 102. The inner walls 103 are on the immediately inward side of the corresponding outer walls of the main assembly 1, and face each other across the internal space of the main assembly 1. One of the inner walls 103 is at one of the widthwise ends of the unit 33, and the other inner wall 103 is at the other widthwise end of the unit 33. The guide rail 101 is a part of one of the mutually facing inner walls 103, and is in the form of a groove. The guide rail 102 is a part of the other inner wall 103, and is also in the form of a groove. The guide rails 101 and 102 are positioned so that they squarely oppose each other as do the pair of inner walls 103. Further, the rails 101 and 102 have tray positioning portions 101*a* and 102*a*, respectively, which are the rail positioning portions of the unit 33. Here, the widthwise direction of the unit 33 is the direction intersectional (perpendicular) to the directions Z1 and Z2 (FIG. 5) in which the unit 33 is moved relative to the main assembly 1.

Figure 5:
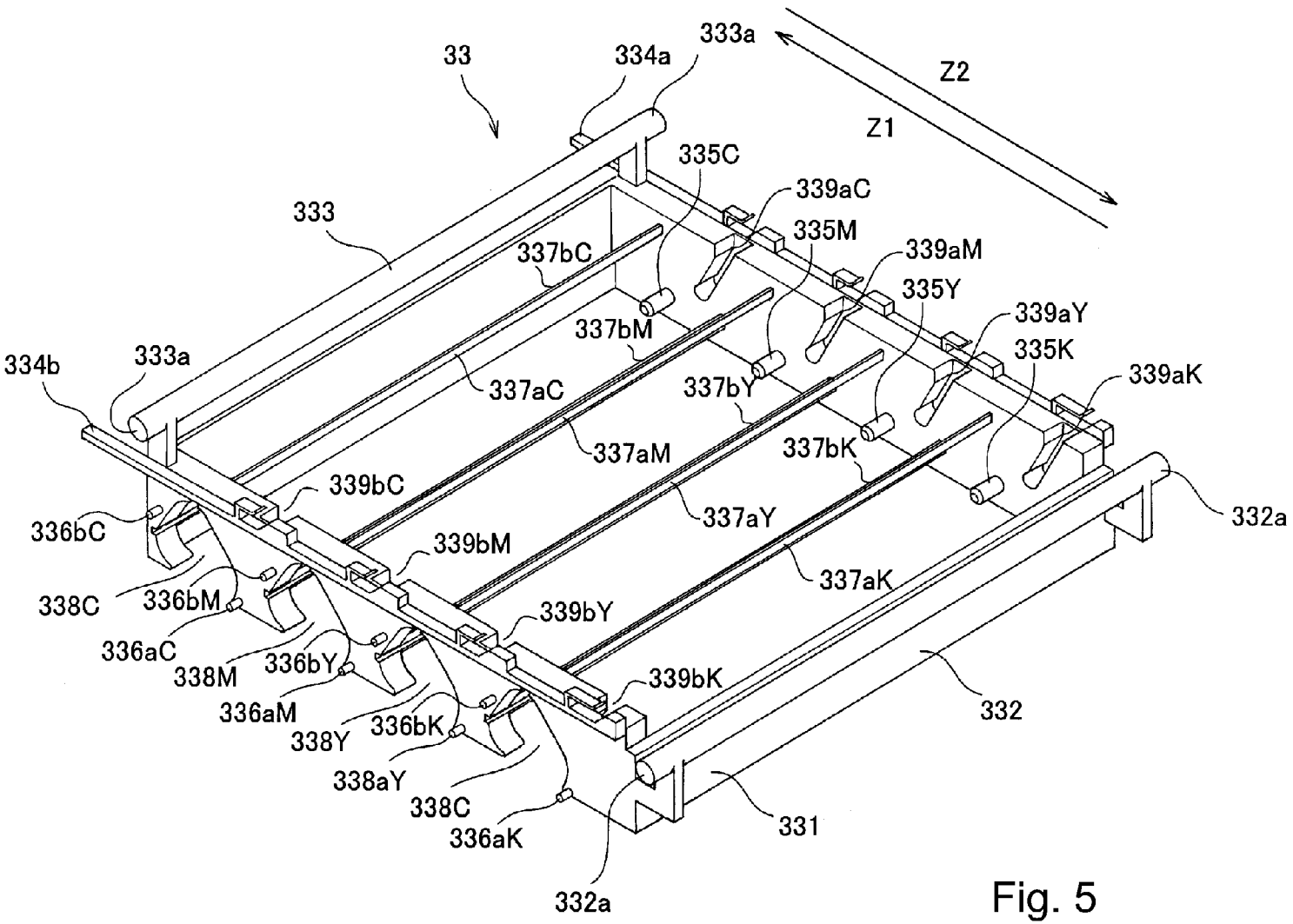
FIG. 5 is a perspective view of the supporting member in the first embodiment.

Next, referring to FIG. 5, the unit 33 has a pair of handholds 332 and 333, which have tray guiding bosses 332*a* and 333*a*, respectively, which are used to guide the unit 33 when the unit 33 is mounted into the main assembly 1. The guide boss 332*a* is guided by the rail 102 when the unit 33 is moved between the innermost position IP and outermost position OP. The guide boss 333*a* is guided by the rail 101 when the unit 33 is moved between the innermost position IP and outermost position OP.

Further, the cover 11 (which can be opened or closed) has a tray contacting portion 11*a* for keeping the unit 33 in the innermost position IP. As the cover 11 is closed when the unit 33 is in the innermost position IP, the tray contacting portion 11*a* keeps the unit 33 in the innermost position IP by coming into contact with the guide boss 332*a*.

As a user moves the unit 33 from the outermost position OP to the innermost position IP, the guide bosses 333*a* and 332*a* move while remaining engaged with the guide rails 101 and 102, respectively, whereby the unit 33 is regulated in its movement. Therefore, the unit 33 remains stable in its movement. It is after the arrival of the bosses 333*a* and 333*b* at the tray positioning portions (of main assembly 1) 101*a* and 102*a*, respectively, when the cover 11 is to be closed. As the cover 11 is closed to completely cover the opening 1*a*, the unit 33 is precisely positioned in the innermost position IP by the cover 11. In this embodiment, the boss 333*a* is precisely positioned by the tray positioning portion 101*a*, whereby the unit 33 is precisely positioned relative to the main assembly 1, as will be described later. Also in this embodiment, the cartridges 31 and 32 are precisely positioned relative to the unit 33, as will be described later. Thus, as the unit 33 is precisely positioned relative to the main assembly 1, the cartridges 31 and 32 are also precisely positioned relative to the main assembly 1. In other words, when the unit 33 is in the innermost position IP, the cartridges 31 and 32 are in their image forming positions described above. As for the position of the bosses 333*a* and 332*a*, they are at the widthwise ends of the unit 33, one for one. Further, in terms of the lengthwise direction of the unit 33, in which the unit 33 is moved into the main assembly 1, the boss 333*a* is at the downstream end of the unit 33, and the boss 332*a* is at the upstream end of the unit 33. Thus, the unit 33 is precisely positioned relative to the main assembly 1 by its lengthwise ends and widthwise ends. Therefore, it is ensured that the unit 33 is precisely positioned relative to the main assembly 1. Here, the abovementioned lengthwise direction of the unit 33 is the direction parallel to the direction Z1, that is, the direction in which the unit 33 is pushed into the main assembly 1. The abovementioned widthwise direction of the unit 33 is the direction perpendicular to the direction Z1, that is, the direction in which the unit 33 is pushed into the main assembly 1. Further, the cover 11 can be opened or closed to expose or cover the opening 1*a*, respectively. The cover 11 is rotatably movable about the axial line of the shaft 11*b*.

The employment of the above described tray unit system makes it possible to perform the cartridge replacement operation outside the main assembly 1, that is, in a wide-open space, making it easier to perform the cartridge replacement operation. In addition, it makes it unnecessary for a user to remove the cartridges 31 and 32 one by one from within the main assembly 1 when it is necessary to remove the sheets 61 having jammed up in the main assembly 1. More concretely, as the user releases a stopper (unshown), the user can pulled (remove) the combination of the unit 33 and cartridges 31 and 32, out of the main assembly 1 by grasping the handholds 332 and 333. Thus, the employment of the above described tray unit system can improve the image forming apparatus in terms of the efficiency with which the jammed sheets 61 can be removed.

In the case of an image forming apparatus structured so that the unit 33 is to be horizontally pulled out of the main assembly 1 as in the case of the image forming apparatus in this embodiment, the operation for replacing the cartridges 31 and 32 can be performed without retracting the laser unit 2. Further, even if the image forming apparatus is structured so that the original reading apparatus (unshown) is in the top portion of the main assembly 1, the operation for replacing the cartridges 31 and 32 can be performed without retracting the original reading apparatus. In other words, not only does the employment of the above described tray unit system improve an image forming apparatus in terms of the cartridge replacement efficiency, but also, makes it unnecessary to provide an image forming apparatus with a mechanism or structural arrangement dedicated to the retraction of the unit 2 and original reading apparatus. That is, the employment of the tray unit system is advantageous also from the standpoint of structural simplification.

<Tray Unit>

Figure 6:
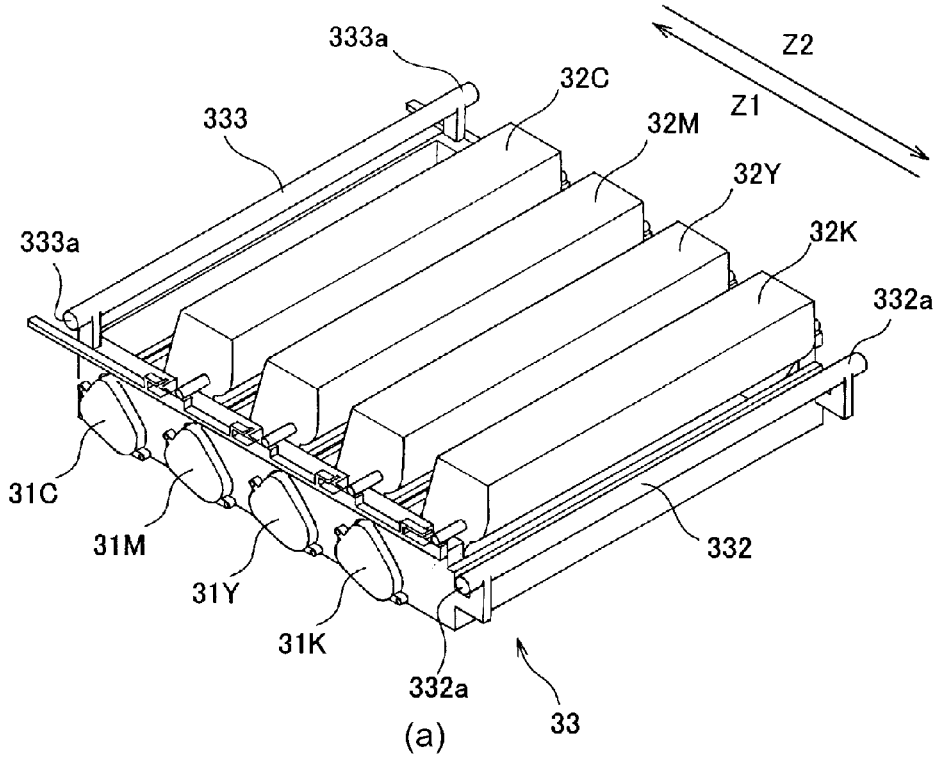
FIG. 6 is a perspective view of the supporting member, and the cartridges on the supporting member, in the first preferred embodiment, and shows the relationship between the supporting member and the cartridges.
Figure 6:
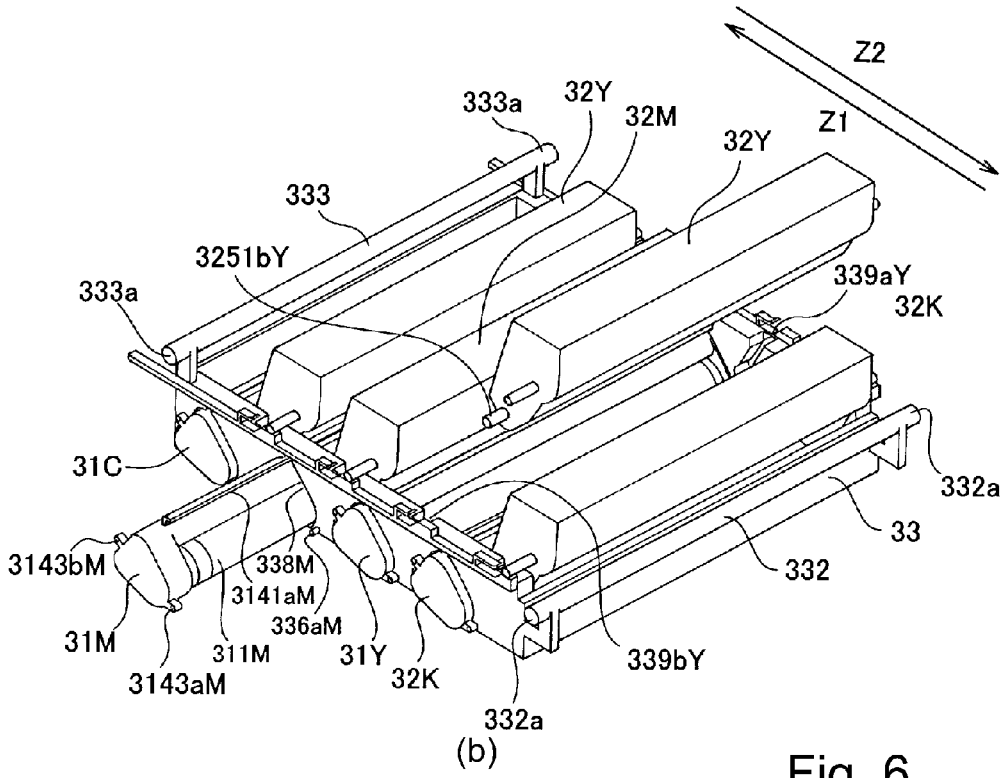

Next, referring to FIGS. 5 and 6(*a*), the tray unit 33 will be described in more detail. FIG. 5 is a perspective view of the tray unit (supporting member) in the first preferred embodiment of the present invention. FIG. 6(*a*) is a perspective view of the tray unit in the first preferred embodiment of the present invention, when the tray unit is holding the cartridges.

The unit 33 has a tray frame 331, and the pair of handholds 332 and 333. The handholds 332 and 333 are where a user is to place his or her hand(s) to grasp the unit 33 when moving the unit 33 relative to the main assembly 1. The handhold 332 is to be grasped by a user to push the unit 33 into the main assembly 1 (direction of arrow mark Z1), or pull the unit 33 out of the main assembly 1 (direction of arrow mark Z2). In terms of the direction (indicated by arrow mark Z1) in which the unit 33 is pushed into the main assembly 1, the handhold 332 is at the upstream end of the unit 33. The handhold 333 is to be grasped by a user when the user removes the unit 33 from the main assembly 1. For example, when it is necessary to remove jammed recording sheet(s), a user is to release the stopper (unshown), and remove the unit 33 from the main assembly 1 by grasping the handholds 332 and 333, so that the jammed recording sheets can be removed.

Further, the unit 33 is provided with a pair of separation bars 334*a* and 334*b* (FIG. 5), which are two of the components that make up the means for placing each of the development rollers 321 in contact with the corresponding photosensitive drum 311, or separating each of the development rollers 321 from the corresponding photosensitive drum 311 (FIG. 5).

The unit 33 is provided with drum positioning shafts (drum positioning members on supporting member side) 335 (335K, 335Y, 335M, and 335C), which correspond in position to the holes 3142, with which the cartridges 31 are provided one for one. Each positioning shaft 335 is projecting inward of the unit 33 in the direction intersectional (perpendicular) to the direction in which the unit 33 is moved relative to the main assembly 1. The number of the shafts 335 matches the number of the cartridges 31 supportable by the unit 33 so that there will be one shaft 335 per cartridge 31 (FIG. 5).

Further, the unit 33 is provided with drum positioning bosses (drum positioning portion on supporting member side) 336*a* (336*a*K, 336*a*Y, 336*a*M, and 336*a*C), which correspond in position to the positioning holes 3143*a*, with which the cartridges 31 supported by the unit 33 are provided, one for one. The boss 336*a* is projecting outward from one of the widthwise end walls of the unit 33, in the direction intersectional (perpendicular) to the direction in which the unit 33 is moved relative to the main assembly 1. The number of bosses 336 matches the number of the cartridges 31 so that there will be one boss 336*a* per cartridge 31. Incidentally, the widthwise direction of the unit 33 is the directions (indicated by arrow marks Z1 and Z2), which is perpendicular to the direction in which the unit 33 is moved relative to the main assembly 1.

Further, the unit 33 is provided with drum positioning bosses (drum positioning portion on supporting member side) 336*b* (336*b*K, 336*b*Y, 336*b*M, and 336*b*C), which correspond in position to the positioning holes 3143*b*, with which the cartridges 31 supported by the unit 33 are provided, one for one. The bosses 336*b* are projecting outward from one of the widthwise end walls of the unit 33, in the direction intersectional (perpendicular) to the direction in which the unit 33 is moved relative to the main assembly 1. Each boss 336*b* is a part of the unit 33, as is each boss 336*a* (FIG. 5).

Further, the unit 33 is provided with guide rails (guide rails of unit 33) 337*a* (337*a*K, 337*a*Y, 337*a*M, and 337*a*C), which engage with the cartridge guides 3141*a*, one for one, with which the cartridges 31 are provided. More concretely, there are four guide rails 337*a*, which extend in the direction perpendicular to the directions Z1 and Z2 (FIG. 5) in which the unit 33 is moved relative to the main assembly 1, that is, the widthwise direction of the unit 33, being disposed with equal intervals. Thus, as each cartridge 31 is inserted into the unit 33, it moves while the guide 3141*a* remains engaged with the guide rail 337*a*; the cartridge 31 is guided to the deepest end of the unit 33 (FIG. 5) by the guides 337*a* and 3141*a*. Incidentally, the direction indicated by the arrow mark Z1 is the direction in which the unit 33 is pushed into the main assembly 1, and the direction indicated by the arrow mark Z2 is the direction in which the unit 33 is pulled out of the main assembly 1 (FIG. 5).

Further, the unit 33 is provided with guide rails (guides which belong to unit 33) 337*b* (337*b*K, 337*b*Y, 337*b*M, and 337*b*C), which engage with the cartridge guides 3141*b*, one for one, with which the cartridges 31 are provided. Thus, as each cartridge 31 is inserted into the unit 33, it moves while the guide 3141*b* remains engaged with the guide rail 337*b*; the cartridge 31 is guided to the deepest end of the unit 33 by the guides 337*b* and 3141*b* (FIG. 5).

As described above, the unit 33 and cartridges 31 are structured so the pair of guides 3141*a* and 3141*b*, with which each cartridge 31 is provided, engage with one of the pairs of rails 337*a* and 337*b*. Thus, it is ensured that each cartridge 31 reliably advances into the unit 33.

Further, the unit 33 is provided with openings (drum cartridge entrance-exit) 338 (338K, 338Y, 338M, and 338C), through which the cartridges 31 are mounted into, or removed from, the unit 33, one for one. More concretely, the left lateral wall of the unit 33, as seen from the upstream side in terms of the unit insertion direction, is provided with four openings 338, which are positioned with equal intervals. The aforementioned pair of boss 336*a* and 336*b* are positioned in a manner of opposing each other across the corresponding opening 338.

Further, the unit 33 is provided with four pairs of development cartridge guiding grooves (development cartridge guiding grooves which belong to supporting member) 339*a* (339*a*K, 339*a*Y, 339*a*M, and 339*a*C) and 339*b* (339*b*K, 339*b*Y, 339*b*M, and 339*b*C), which guide the cartridges 32, one for one. In terms of the widthwise direction of the unit 33, the guiding grooves 339*a* are at one end of the unit 33, being positioned with equal intervals, and the guiding groove 339*b* are at the other end of the unit 33, being positioned with equal intervals (in terms of directions Z1 and Z3), so that the guiding grooves 339*a* and 339*b* squarely oppose each other, one for one, across the internal space of the unit 33.

Each of the aforementioned pairs of development cartridge positioning shaft 3251*a* and 3252*a* engages into the corresponding guide groove 339*a*, and each of the aforementioned pairs of cartridge positioning shaft 3251*b* and 3252*b* engages into the corresponding guiding groove 339*b*. That is, when the cartridge 32 is mounted into the unit 33, the shaft 3251*a* comes into contact with the walls of the guiding groove 339*a*, being thereby guided downward toward the bottom of the unit 33, and the shaft 3251*b* comes into contact with the walls of the guiding groove 339*b*, being thereby guided downward toward the bottom of the unit 33.

The unit 33 can be moved relative to the main assembly 1 while all the cartridges 31 and 32 are supported by the unit 33 (FIG. 6(*a*)). Thus, as the unit 33 is moved in the direction indicated by the arrow mark Z1, it moves into the main assembly 1, whereas as the unit 33 is moved in the direction indicated by the arrow mark Z2 while the unit 33 is in the main assembly 1, it comes out of the main assembly 1.

When a user wants to perform the operation for replacing the cartridge(s) 31 and/or 32, the user is to pull the unit 33 out of the main assembly 1 before the user starts the operation; the operation is to be performed when the unit 33 is in the outermost position OP.

<Mounting of Drum Cartridge into Tray Unit, and Removal of Drum Cartridge from Tray Unit>

Next, the method for mounting or removing the cartridge 31 will be described with reference to the appended drawings, in particular, FIGS. 5 and 6(*b*). FIG. 6(*b*) is a perspective view of the combination of the tray unit 33 and the four cartridges 31 and four cartridge 32, in the first preferred embodiment of the present invention, and is for describing the operation for mounting the cartridges 31 and 32 into the tray unit 33, or removing the cartridges 31 and 32 from the tray unit 33.

The image forming apparatus 100 is structured so that each cartridge 31 is independently mounted into, or removed from, the unit 33, from the cartridges 32.

The method for mounting the cartridge 31 into the unit 33 is as follows: First, the cartridge 31 is to be inserted into the unit 33 in the direction parallel to the axial line of the drum 311 (lengthwise direction of cartridge 31) through the opening 338, while positioning the cartridge 31 so that the cartridge guides 3141*a* and 3141*b* engage with the guide rails 337*a* and 337*b*, respectively, of the unit 33. That is, the cartridge 31 is to be inserted into the rearmost end of the unit 33 while the guides 3141*a* and 3141*b* are guided by the rails 337*a* and 337*b*, respectively. Since the guides 3141*a* and 314*b* remain engaged with the rails 337*a* and 337*b*, the cartridge remains roughly horizontal while it is mounted into the unit 33. Thus, the cartridge 31 is removably supported by the unit 33.

As the cartridge 31 is inserted to almost the deepest end of the unit 33, the positioning shaft 335 of the unit 33 engages into the positioning hole 3142, with which the leading end of the cartridge 31 (in terms of cartridge insertion direction X) is provided. Then, lastly, the positioning bosses 336*a* and 336*b* of the unit 33 engage into the positioning holes 3143*a* and 3143*b*, respectively, with which the trailing end of the cartridge 31 (in terms of cartridge insertion direction X) is provided. As a result, the cartridge 31 becomes precisely positioned relative to the unit 33.

When the unit 33 is moved from its outermost position OP to its innermost position IP while the unit 33 is holding the cartridges 31, the drum cartridge frame 314 comes into contact with the inner walls 103, whereby the cartridge 31 is precisely positioned relative to the main assembly 1 in terms of its lengthwise direction.

If a user wants to remove the cartridge 31 from the unit 33, the user has only to pull the cartridge 31 in the direction parallel to the axial line of the photosensitive drum 311 so that it will come out through the opening 338.

Incidentally, FIG. 6(*b*) shows the combination of the unit 33 and cartridges 31 and 32, when the cartridge 31M is halfway out of, or halfway into, the unit 33.

<Mounting of Development Cartridge into Tray Unit, and Removal of Development Cartridge from Tray Unit>

Next, referring to the appended drawings, in particular, FIGS. 3(*b*), 5, and 6(*b*), the method for mounting or removing the cartridge 32 will be described.

As described above, the unit 33 is provided with the four pairs of cartridge guiding grooves 339*a* and 339*b* (FIG. 5). Further, the unit 33 and cartridge 32 are structured so that the direction in which each cartridges 32 is allowed to move, and the attitudinal changes which might occur to the cartridge 32, when the cartridge 32 is mounted into, or removed from, the unit 33, are regulated by the angle and shape of the guiding grooves 339*a* and 339*b*. Thus, even in the case where the cartridges 32 are mounted into, or removed from, the unit 33 when the cartridges 31 are already in the unit 33, it does not occur that the cartridges 31 interfere with the mounting or removal of the cartridges 32.

While the unit 33 is in its outermost position, the cartridges 31 are kept separated from the corresponding cartridges 32 by the resiliency of the tension springs 3341, as will be described later. Therefore, it is possible to prevent the problem that when the cartridges 31 and 32 are mounted into, or removed from, the unit 33, the photosensitive drums 311 and development rollers 321 become damaged by coming in contact with each other.

As described above, each cartridge 32 is provided with a pair of development cartridge positioning shafts 3251*a* and 3251*b*.

Thus, a user who wants to mount a cartridge 32 into the unit 33 is to insert the cartridge 32 as follows: First, the cartridge 32 is to be positioned so that the positioning shafts 3251*a* and 3251*b* align with the guiding grooves 339*a* and 339*b*, respectively, and then, to move the cartridge 32 downward so that the shafts 3251*a* and 3251*b* follow the grooves 339*a* and 339*b*, respectively. Also as described above, in this embodiment, the unit 33 is to be horizontally pulled out in straight line (direction indicated by arrow mark Z2) from the main assembly 1 while the main assembly 1 remains on a horizontal surface. Then, each cartridge 32 is to be mounted into (supported by) the unit 33 by being moved vertically downward while the unit 33 is in its outermost position. Thus, if the user wants to take any of the cartridges 32 out of the unit 33, the user has only to carry out in reverse the above described operation for mounting the cartridge 32 into the unit 33. That is, all that the user has to do is to pull the unit 33 out of the main assembly 1 into its outermost position, and move the cartridge vertically upward (FIG. 6(*b*)).

Also as described above, when each cartridge 32 is mounted into the unit 33, it is moved vertically moved downward into the unit 33, whereas when the cartridge 32 is removed from the unit 33, it is moved vertically upward. However, the direction in which the cartridge 32 is moved when it is mounted into, or removed from, the unit 33 is not perfectly vertical; it is slightly angled relative to the vertical direction, as will be evident from FIG. 5.

Incidentally, FIG. 6(*b*) shows the combination of the unit 33 and the cartridges 31 and 32, when the cartridge 32Y is being mounted into, or removed from, the unit 33.

<Direction in which Cartridge is Mounted into Unit 33, and Direction in which Cartridge is Removed from Unit 33>

As described above, in this embodiment, the image forming apparatus 100 is structured so that each of the cartridges 31 and 32 can be independently mounted into, or removed from, the unit 33, from the other cartridges 31 and 32. Further, the image forming apparatus 100 is structured so that each cartridge 31 is paired with the corresponding cartridge 32, and multiple (four) pairs of cartridge 31 and 32 are aligned in parallel in the directions (indicated by arrow marks Z1 and Z2) in which the unit 33 is movable; each pair of cartridges 31 and 32 are supported by the unit 33 so that their lengthwise directions are intersectional (perpendicular) to the above-mentioned moving directions Z1 and Z2 of the unit 33 (FIGS. 6(*a*) and 6(*b*)). Incidentally, the lengthwise direction of each cartridge 31 is the direction parallel to the lengthwise direction (axial line) of the drum 311 in the cartridge 31. Further, the lengthwise direction of each cartridge 32 is the direction parallel to the lengthwise direction (axial line) of the development roller 321 in the cartridge 32.

Further, the image forming apparatus 100 (unit 33) is structured so that the direction in which each cartridge 31 is mounted into, or removed from, the unit 33, are different from the direction in which each cartridge 32 is mounted into, or removed from, the unit 33. That is, the image forming apparatus 100 (unit 33) is structured so that the direction in which each cartridge 31 is mounted into, or removed from the unit 33, is perpendicular to the direction in which each cartridge 32 is mounted into, or removed from the unit 33. Further, in the image forming apparatus 100 (unit 33), each cartridge 31, and each cartridge 32, are structured so that each cartridge 31 and 32 can be independently mounted into, or removed from, the unit 33, from the other cartridges 31 and 32. More concretely, the image forming apparatus 100 (unit 33) is structured so that each cartridge 31 is to be horizontally mounted or dismounted in the direction parallel to the axial line of the photosensitive drum 311, whereas each cartridge 32 is to be mounted or dismounted in the direction which is roughly vertical and is perpendicular to the axial line of the development roller 321. It should be noted here that while any of the cartridges 31 and 32 remains properly situated (supported) in the unit 33, the axial lines of the photosensitive drum 311 and development roller 321 in the cartridge are parallel to each other.

Further, as described above, the image forming apparatus 100 is structured so that while the main assembly 1 is on a horizontal surface, the unit 33 is horizontally movable, and also, so that the direction in which each cartridge 31 is mounted into, or dismounted from, the unit 33 is horizontal, and is perpendicular to the direction in which the unit 33 is movable.

Also as described above, while the main assembly 1 remains horizontal, the moving direction of the unit 33 (indicated by arrow marks Z1 and Z2) is perpendicular to the direction in which each cartridge 31 is mounted into, or dismounted from, the unit 33. The moving direction of the unit 33 is roughly perpendicular to the direction in which each cartridge 32 is mounted into, or dismounted from, the unit 33. Here, the moving direction of the unit 33 means the direction in which the unit 33 is moved between its innermost position in the main assembly 1 and the outermost position from the main assembly 1.

In order to minimize in size the main assembly 1 of the image forming apparatus 100, the image forming apparatus 100 in this embodiment is structured so that while the main assembly 1 remains on a horizontal surface, each cartridge 32 and the corresponding cartridge 31 partially overlap each other in terms of the vertical direction.

Figure 7:
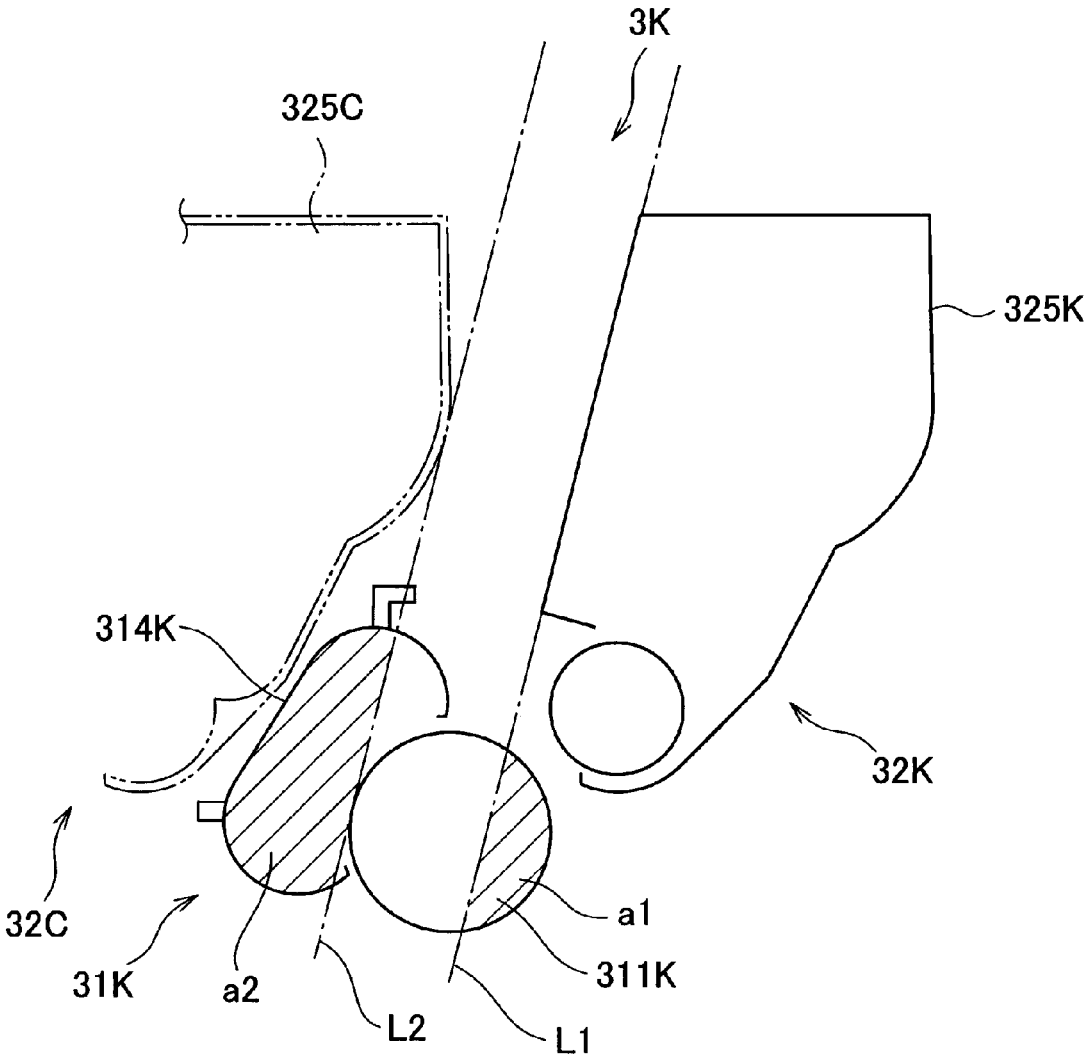
FIG. 7 is a schematic drawing for describing the positional relationship between one of the drum cartridges, and the corresponding development cartridge, in the first preferred embodiment.

Next, referring to FIG. 7, the abovementioned setup will be described. FIG. 7 shows the cartridge 32C and 32K as the examples of the cartridges 32, and the cartridge 31K. The cartridge 31K is extending beyond the area sandwiched by two lines L1 and L2, that is, the maximum gap between the cartridges 32C and 32K, by its hatched portions a1 and a2 in the drawing. In other words, the image forming apparatus 100 is structured so that the cartridge 31K fits into the space between the bottom portions of the adjacent two cartridges 32K and 32C.

That is, while the two cartridges 31 and 32 remain properly mounted (supported) in the unit 33, a part (hatched portion in FIG. 7) of the cartridge 31 remains under the adjacent two cartridges 32, reducing in size the space for supporting (mounting) the cartridges 31 and 32. Thus, this setup can reduce in size the main assembly 1.

Even though the image forming apparatus 100 (unit 33) in this embodiment is structured so that while the cartridges 31 and 32 remain properly supported in the unit 33, a part of each cartridge 31 is positioned below the corresponding cartridge 32, the cartridges 31 and 32 are not affected in terms of the efficiency with which they can be mounted or dismounted, because the image forming apparatus 100 (unit 33) in this embodiment is also structured so that the direction in which each cartridge 31 is mounted or dismounted is perpendicular to the direction in which each cartridge 32 is mounted or dismounted. The employment of this structural arrangement makes it possible for each of the cartridges 31 and 32 to be independently mounted into, or dismounted from, the unit 33, from the other cartridges. In other words, it is possible to exchange only the cartridge which needs to be replaced.

<Mechanism for Placing Development Roller in Contact with, or Separating Development Roller from Photosensitive Drum>

Next, referring to FIGS. 1, 5 and 8, the means for placing a development roller 32 in contact with, or separating the development roller 32 from, a photosensitive drum 311 will be described. Hereafter, this means may be referred to simply as a development roller moving means (mechanism). The means for moving a cartridge 32 is in the form of a mechanism for placing a development roller 321 in contact with, or separating from, a photosensitive drum 311. FIGS. 8A, 8B, and 8C are drawings for describing the working of the development roller moving means in the first preferred embodiment of the present invention, and are side views of the unit 33, as seen from the side where the openings 338 are present.

In order to form an image (when development roller 321 is in its development position), the drum 311 and development roller 321 must be in contact with each other. On the other hand, when mounting the cartridge 31 into the unit 33, or dismounting the cartridge 31 from the unit 33, it is desired that the drum 311 and development roller 321 are not in contact with each other, in order to prevent the drum 311 and/or development roller 321 from being damaged when the cartridge 31 is mounted or dismounted.

Moreover, in a case where a black-and-white image is formed, the cartridge 32Y, 32M, and 32C are not used. Therefore, from the standpoint of the prevention of the unnecessary wear of the cartridges 32Y, 32M, and 32C, it is desired that these development cartridges 32 are kept separated from the corresponding photosensitive drums 311.

Thus, the image forming apparatus 100 and each of the cartridges 32 are provided with the mechanism for placing and keeping the development roller 321 in contact with, or separating and keeping separated the development roller 321 from, the photosensitive drum 311, while keeping the cartridges 31 and 32 mounted in the unit 33.

More concretely, the main assembly 1 is provided with a pair of separation bar driving gears 34*a* and 34*b* (FIGS. 1, 4, and 8), whereas the unit 33 is provided with a pair of separation bars 334*a* and 334*b*, which are moved by the pair of gears 34*a* and 34*b*, respectively. The separation bar 334*a* is at one of the widthwise ends of the unit 33, and the separation bar 334*b* is at the other widthwise end (FIG. 5). The gears 34*a* are 34*b* are positioned so that as the unit 33 is pushed into the main assembly 1, the separation bars 334*a* and 334*b* come into contact with the gears 34*a* and 34*b*, respectively. The gears 34*a* and 34*b* are rotated by the driving force from a motor M (FIG. 8), which is controlled (rotated or stopped) by a controlling means C (FIG. 8). The gears 34*a* and 34*b* and separation bars 334*a* and 334*b* are the primary structural components of the development roller moving means. As described before, in this embodiment, the development roller 321 is one of the integral parts of the cartridge 32. Therefore, the roller 321 is placed in contact with, or separated from, the drum 311 by the movement of the cartridge 32.

Shown in FIG. 8 is only the side of the combination of the unit 33 and cartridges 31 and 32, where the gear 34*b* and separation bar 334*b* are present. Since the structures and functions of the gear 34*a* and separation bar 334*a* are the same as those of the gear 34*b* and separation bar 334*b*, only the structures and functions of the gear 34*b* and 334*b* will be described.

Figure 8A:
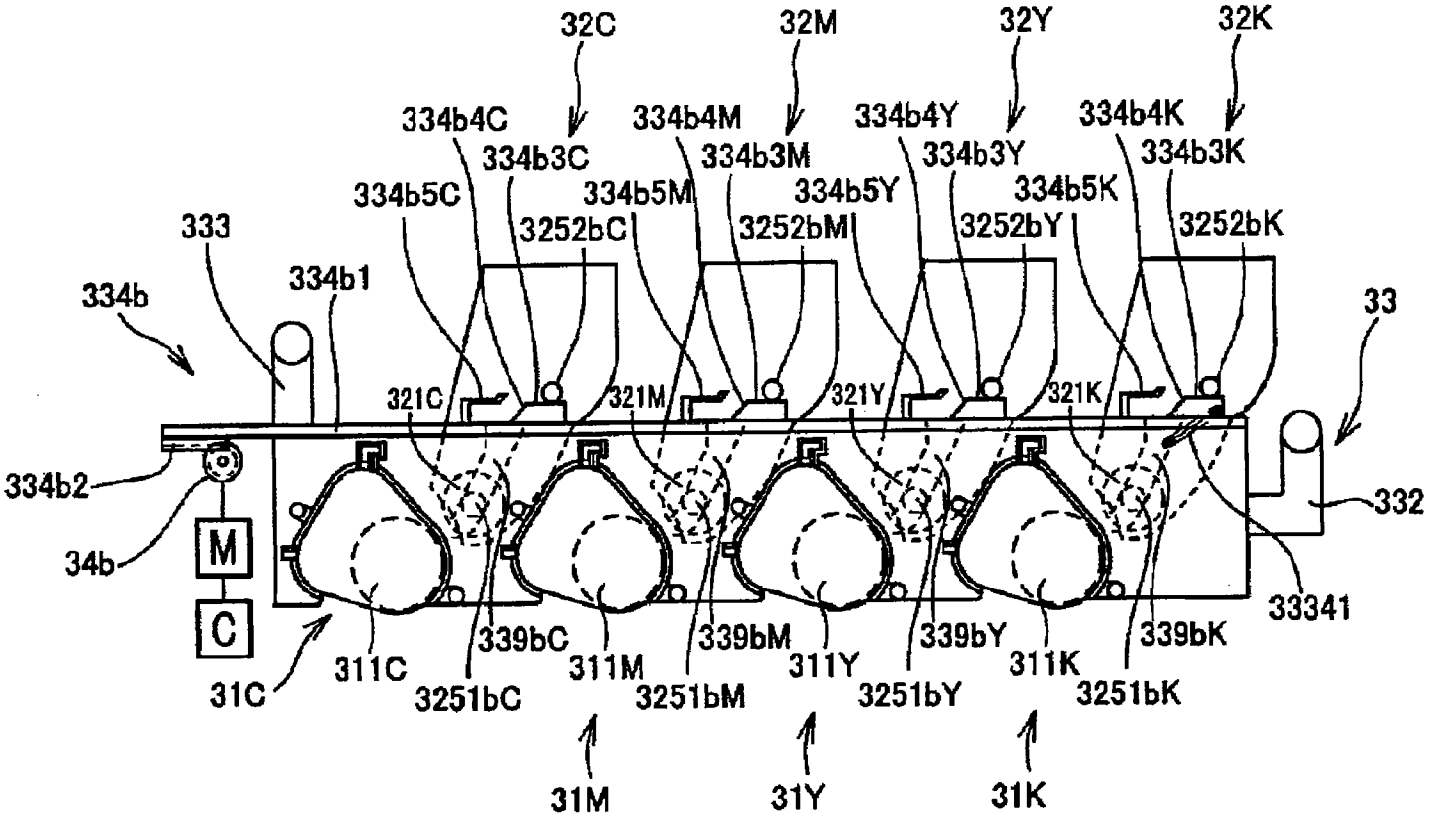
FIG. 8A, FIG. 8B and FIG. 8C are views illustrating the mechanism for placing the development cartridges in contact with the corresponding photosensitive drums, or separating the development cartridges from the corresponding photosensitive drums, in the first preferred embodiment.

FIG. 8A shows the combination of the unit 33 and cartridges 31 and 32, when all the development rollers 321 of all the cartridges 32 are remaining separated from the corresponding photosensitive drums 311. FIG. 8B shows the combination of the unit 33 and cartridges 31 and 32, when only the development roller 321K, that is, the development roller of the cartridge 32K, is in contact with the corresponding photosensitive drum 311, that is, the drum 311K. FIG. 8C shows the combination of the unit 33 and cartridges 31 and 32, when all development rollers 321 of all cartridges 32 are in contact with the corresponding drums 311, one for one.

The separation bar 334*b* has a rod portion 334*b*1, which extends along the top edge of the lateral plate of the unit 33. The rod portion 334*b*1 is provided with a rack portion 334*b*2, which is at one end of the rod portion 334*b*1. The rack portion 334*b*2 meshes with the teeth of the gear 34*b* as the unit is moved into its innermost position IP. That is, the unit 33 is provided with the rack portion 334*b*2, which remains meshed with the teeth of the gear 34*b* when the unit 33 remains properly stored in the main assembly 1.

Further, the rod portion 334*b*1 is provided with four separation seat areas 334*b*3 (334*b*3K, 334*b*3Y, 334*b*3M, and 334*b*3C) and four slant surfaces 334*b*4 (334*b*4K, 334*b*4Y, 334*b*4M, and 334*b*4C), which correspond in position to four cartridges 32, one for one.

Further, the rod portion 334*b*1 is provided with four contact engagement portions 334*b*5 (334*b*5K, 334*b*5Y, 334*b*5M, and 334*b*5C), which correspond in position to the four cartridges 32, one for one.

Further, referring to FIG. 8, the separation bar 334*b* is kept pulled leftward by the resiliency of a tension spring (elastic member) 3341 attached to the unit 33 by one of its lengthwise ends. Thus, when the rack portion 334*b*2 is not in mesh with the teeth of the gear 34*b* (for example, when the unit 33 is in its outermost position OP), the state of the combination of the unit 33 and cartridges 31 and 32 is as shown in FIG. 8A.

Referring again to FIG. 8, the image forming apparatus 100 is structured so that the gear 34*b* is rotatable in the clockwise and counterclockwise directions by the driving force from the motor M with which the main assembly 1 is provided, by a preset angle; the driving force (rotational force) from the motor M is transmitted to the gears 34*a* and 34*b* by a known driving force transmitting means. As the unit 33 is moved back into its innermost position IP in the main assembly 1, the rack portion 334*b*2 is engaged with the teeth of the gear 34*b*, as described above. Then, the gear 34*b* is rotated while its rotation is controlled by the controlling means C. That is, the controlling means C, with which the main assembly 1 is provided, controls the rotation of the motor M based on the information regarding the development roller separation and the information regarding the development, so that the separation bar 334*b* is moved in the leftward or rightward in FIG. 8.

When the separation bar 334*b* is in the position shown in FIG. 8A, the positioning shaft 3251*b* of the cartridge 32 is in the guide groove 339*b*, with which the unit 33 is provided. However, the separation boss 3252*b* of the cartridge 32 is on the top of the separation seat area 334*b*3. Thus, the cartridge 32 is prevented from moving toward the drum 311. That is, the cartridge 32 (more concretely, development roller 321) remains separated from the photosensitive drum 311 (FIG. 8A).

Figure 8B:
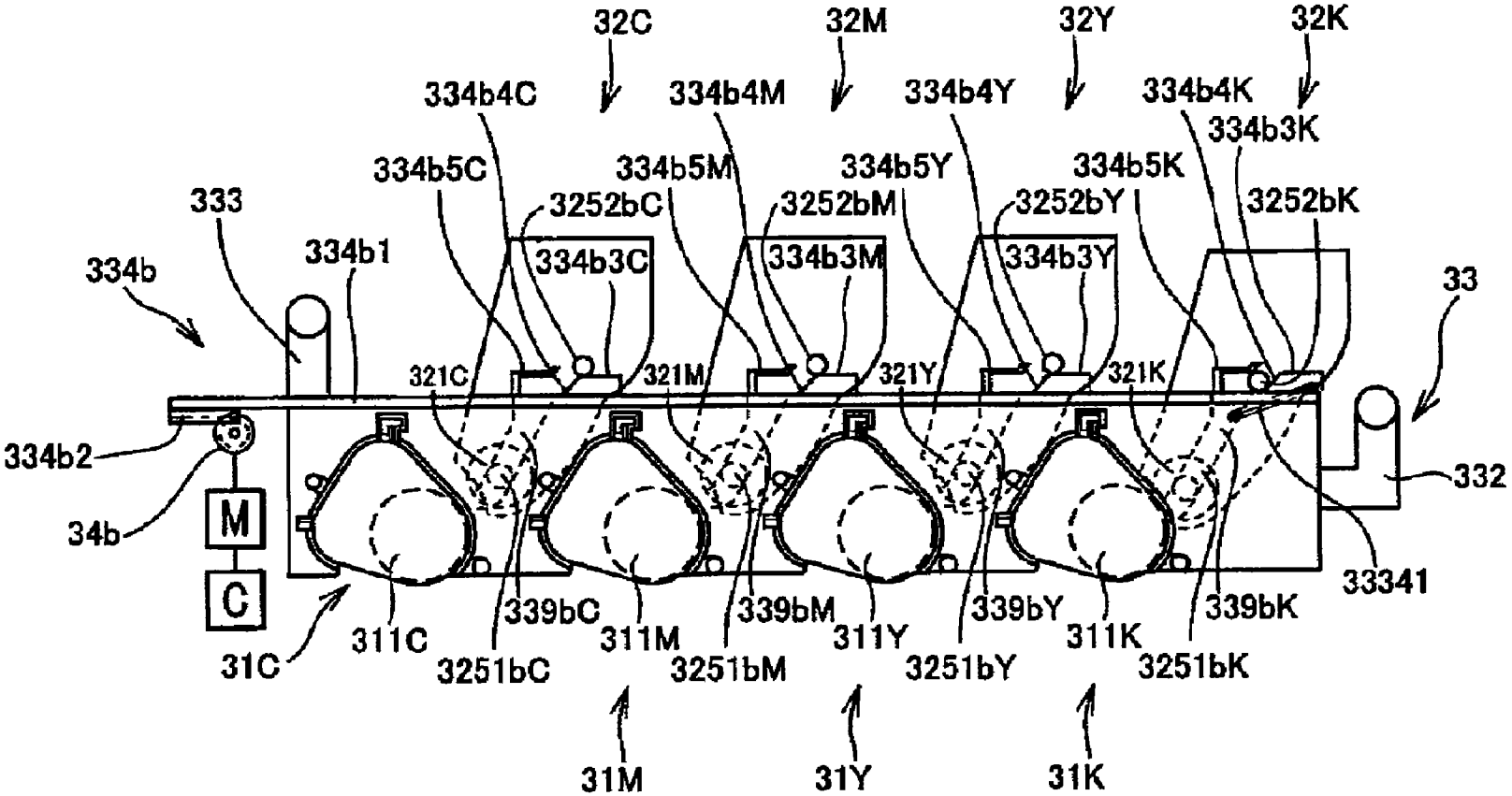

As the gear 34*b* is rotated by the driving force from the motor M by a preset angle in the clockwise direction (FIG. 8), the separation bar 334*b* moves rightward (FIG. 8B). As the separation bar 334*b* moves rightward, only the separation boss 3252*b* of the cartridge 32K slides down the slanted surface 334*b*4K, and engages with the engaging portion 334*b*5K (FIG. 8B).

The above described movement of the separation boss 3252*b*K allows the cartridge 32K to move toward the photosensitive drum 311K in such a manner that the positioning shaft 3251*b*K of the cartridge 32K follows the guiding groove 339*b*K. As a result, the cartridge 32K (more specifically, development roller 321K) comes into contact with the photosensitive drum 311K (FIG. 8B).

During this movement of the cartridge 32K, the other cartridges 32Y, 32M, and 32C remain in their positions, in which their separation bosses 3252*b* remain on the separation seat area 334*b*3. Therefore, their development cartridges 32 (more specifically, development rollers 321) remain separated from the corresponding photosensitive drums 311 (FIG. 8B).

Figure 8C:
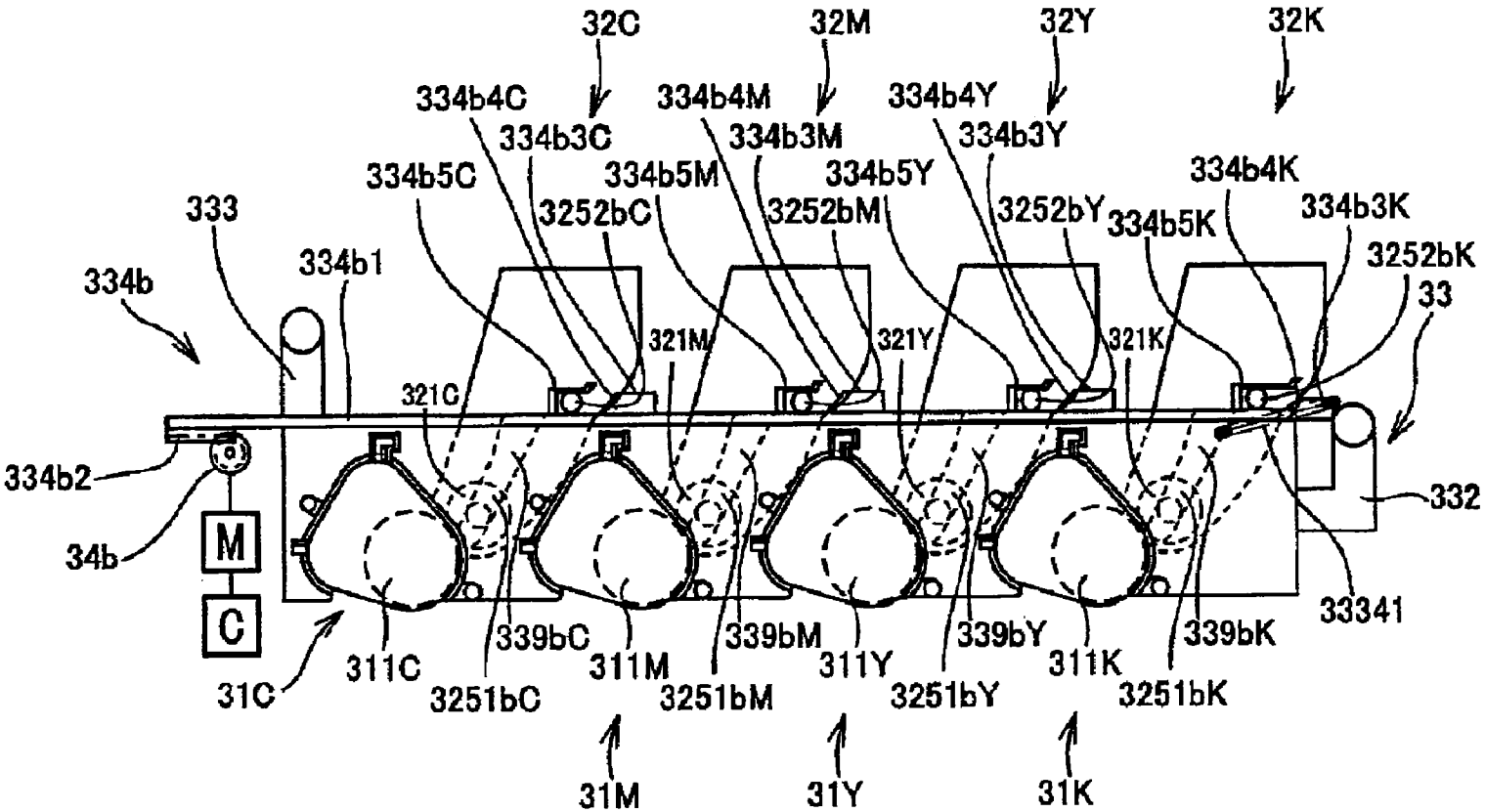

As the gear 34*b* is rotated further in the clockwise direction (FIG. 8C) by the driving force from the motor M, the separation bar 334*b* moves further rightward (FIG. 8C). This further rightward movement of the separation bar 334*b* causes the separation bosses 3252*b* of the other cartridges 32Y, 32M, and 32C to slide down the slanted surfaces 334*b*4, and engage with the engaging portions 334*b*5Y, 334*b*5M, and 334*b*5C, respectively. (FIG. 8C).

The above described movement of the separation bosses 3252*b*Y, 3252*b*M, and 3252*b*C allows the other cartridges 32Y, 32M, and 32C to move toward the drums 311 in such a manner that their positioning shafts 3251*b* follow the corresponding guiding grooves 339*b*, one for one. As a result, these cartridges 32Y, 32M, and 32Y (more specifically, development rollers 321Y, 321M, and 321C) also come into contact with the photosensitive drums 311Y, 311M, and 311C, respectively.

As for the cartridge 32K, its engaging portion 334*b*5K and separation boss 3252*b*K remain engaged with each other. Therefore, the development roller 321K remains in contact with the photosensitive drum 311K (FIG. 8C).

On the other hand, as the gear 34*b*, which is in the state shown in FIG. 8C, is rotated in the counterclockwise direction (FIG. 8) by the driving force from the motor M, the separation bar 334*b* moves leftward, moving to the position shown in FIG. 8B, and then, to the position shown in FIG. 8A.

As described above, when it is necessary to move the development roller 321, which is in its development position (in which it is in contact with photosensitive drum 311), away from the development position, the controlling means C rotates the gear 34*b* in the counterclockwise direction to move the separation bar 334 leftward so that the engaging portion 334*b*5 separates from the separation boss 3252*b*. This separation of the engaging portion 334*b*5 from the separation boss 3252*b* allows the development roller 321 to move from the abovementioned development position (in which it is in contact with photosensitive drum 311) (FIGS. 8C→8B→and 8A). Further, when it is necessary to move the development roller 321, which is not in its development position (in which it is in contact with photosensitive drum 311), into the development position, the controlling means C moves the separation bar 334 rightward by rotating the gear 34*b* in the clockwise direction. This rightward movement of the separation bar 334 causes the engaging portion 334*b*5 to engage with the separation boss 3252*b*. As a result, the development roller 321 is moved into the abovementioned development position (FIG. 8A→8B→8C).

As described above, the development roller 321 can be placed in contact with, or separated from, the photosensitive drum 311, by controlling the rotation of the gear 34*b* by the controlling means C. When a user wants to form a color image, all that the user has to do is to place all the development rollers 321 in contact with the photosensitive drums 311, one for one (as shown in FIG. 8C).

On the other hand, if a user wants to form only a black-and-white image, all that the user has to do is for the user to place the image forming apparatus 100 in the state shown in FIG. 8B. Placing the image forming apparatus 100 in the state shown in FIG. 8B can prevent the photosensitive drums 311 and development rollers 321 other than those for forming a black-and-white image, from being unnecessarily worn.

Also as described above, in a case where the teeth of the gear 34*b* are not in mesh with the teeth of the separation bar 334*b*, the separation bar 334*b* is moved into the state shown in FIG. 8A, because it is under the resiliency of the tension spring (elastic member) 3341 which continuously pulls the separation bar 334*b* in the leftward direction in FIG. 8.

That is, while the unit 33 is out of the main assembly 1, the teeth of the gear 34*b* are not in mesh with the teeth of the rack portion of the separation bar 334*b*. Therefore, all the development rollers 321 remain separated from the corresponding photosensitive drums 311. Therefore, it does not occur that when the cartridge 31 and/or cartridge 32 is mounted or dismounted, the development roller 321 and/or photosensitive drum 311 is damaged by the contact between them.

<Advantages of Image Forming Apparatus in this Embodiment>

As described above, the image forming apparatus 100 in this preferred embodiment is structured so that the direction in which the cartridge 31 is mounted into, or dismounted from, the unit 33, is perpendicular to the direction in which the cartridge 32 is mounted into, or dismounted from, the unit 33. Therefor, each cartridge 31 and each cartridge 32 can be independently mounted into, or dismounted from, the unit 33, from the other cartridges.

Further, as described above, in order to minimize in size the image forming apparatus 100 in this embodiment, the image forming apparatus 100 is structured so that a part of each cartridge 31 is below the adjacent cartridge 32. In spite of this structural arrangement, the image forming apparatus 100 is not inferior to any of the conventional image forming apparatuses in terms of the ease and efficiency with which the cartridges 31 and 32 can be mounting or dismounted.

Embodiment 2

Next, referring to FIGS. 9-17, the image forming apparatus 200 in the second preferred embodiment of the present invention will be described. Any of the components, members, portions, etc., of the image forming apparatus 200 shown in FIGS. 9-17, which is the same in basic structure and function as that of the image forming apparatus 100 in the first preferred embodiment, is given the same numerical code or the like, and will not be described. Also in this embodiment, the referential letters "K", "Y", "M" and "C" are added, as color reference, to the referential codes. However, these referential letters may be left out at discretion.

Figure 9:
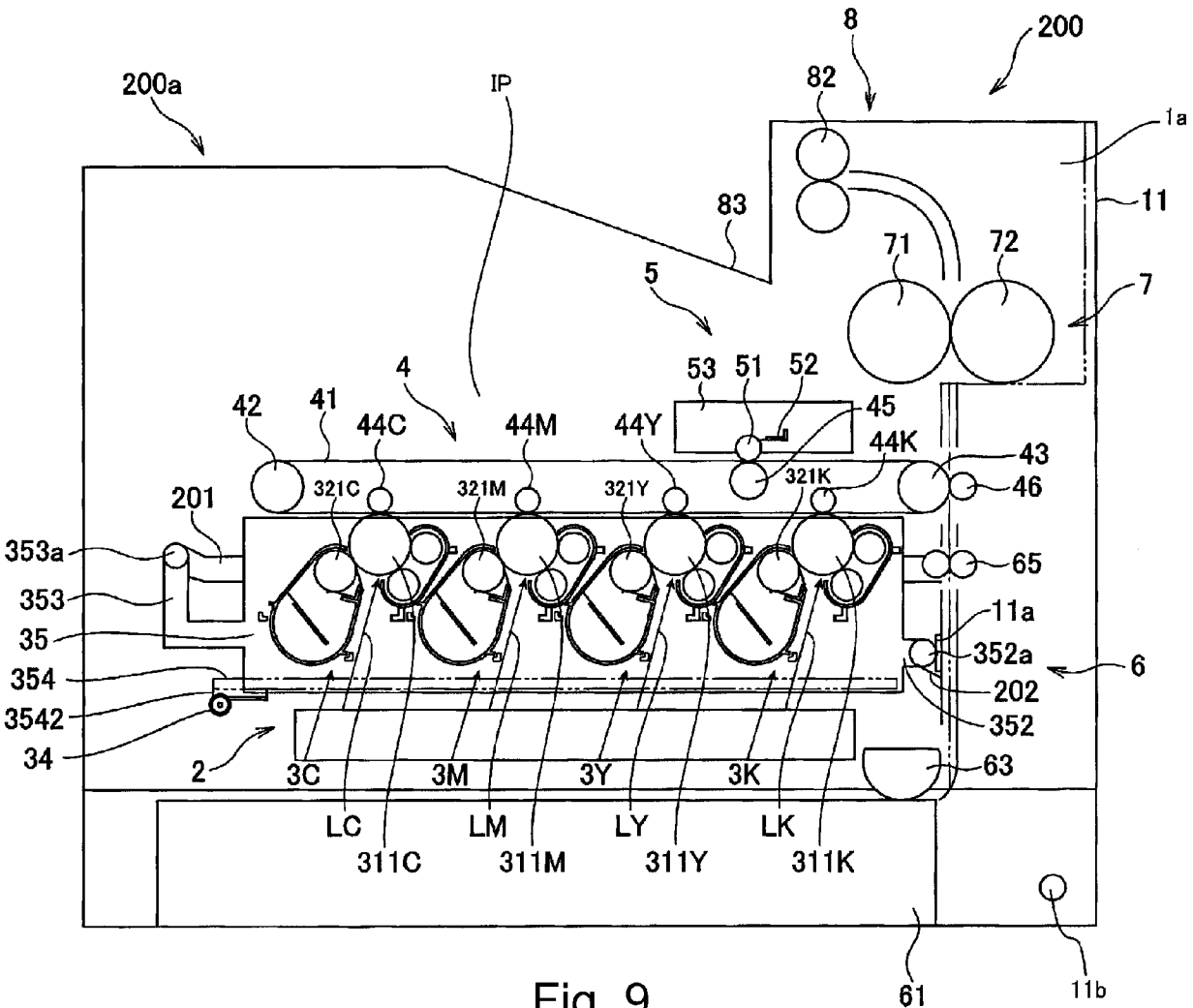
FIG. 9 is a sectional view of the image forming apparatus in the second preferred embodiment of the present invention, and shows the general structure of the apparatus.

First, referring to FIG. 9, the image forming apparatus 200 in the second preferred embodiment of the present invention will be described regarding its overall structure. FIG. 9 is a schematic sectional view of the image forming apparatus 200, and shows the overall structure of the apparatus 200.

The image forming apparatus 200 is different from the image forming apparatus 100 in the first preferred embodiment, in that the laser unit 2 is below the combination of the sequentially positioned image forming portions 3. Beams of laser lights LK, LY, LM, and LC are projected by the laser unit 2 upon the photosensitive drums 311, with which the image forming portions 3 are provided, one for one. As a result, an electrostatic latent image, which reflects the information regarding the image to be formed, is formed on each of the photosensitive drums 311.

The image forming apparatus 200 in this embodiment is also different from the image forming apparatus 100 in the first embodiment in that the transfer unit 4 for transferring the development images formed on the photosensitive drums 311, onto the sheet 61, is above the combinations of the image forming portions 3.

Further, the image forming apparatus 200 in this embodiment is different from the image forming apparatus 100 in the first embodiment, in that the recovery unit 5 for recovering the developer t which remained adhered to the transfer belt 41 of the transfer unit 4 after the development image transfer, is above the transfer unit 4.

Further, the image forming apparatus 200 in this embodiment is different from the image forming apparatus 100 in the first embodiment, in that the fixation unit for fixing the unfixed development image on the sheet 61 after the transfer of the unfixed image onto the sheet 61, is located diagonally upward on the right side of the transfer unit 4 (FIG. 9). Further, the discharging portion 8 for discharging the sheet 61 out of the main assembly 1 after the fixation of the developer image to the sheet 61 is above the fixation unit 7.

The conveying portion 6, image forming portion 3, recovery unit 5, fixation unit 7, and discharging portion 8 of the image forming apparatus 200 in this embodiment are roughly the same in basic structure and function as those of the image forming apparatus 100 in the first embodiment, even though there are slight differences in their positioning and structure. Therefore, their detail descriptions will be left out.

<Transfer Unit>

Next, referring to FIG. 9, the transfer unit 4 will be described.

The transfer unit 4 in this preferred embodiment is different in structure from the above described transfer unit 4 in the first preferred embodiment. That is, the image forming apparatus 200 in this preferred embodiment is structured so that the four monochromatic developer images, different in color, formed on the multiple photosensitive drums 311, one for one, are sequentially transferred in layers onto the transfer belt 41, by the transfer unit 4, yielding thereby a full-color image on the transfer belt 41, and then, the four monochromatic toner images, of which the single full-color image is made up, are transferred all at once onto the sheet 61.

Further, the transfer unit 4 has: a roller 45 positioned in a manner to oppose the recovery roller 51 of the recover unit 5, with the presence of the transfer belt 41 between the roller 45 and recovery roller 51; and a secondary transfer roller 46 for transferring all at once the four developer images on the transfer belt 41, onto the sheet 61.

As a preset transfer bias is applied to the transfer roller 46 by a bias applying means (unshown), the transfer roller 46 transfers all at once the four developer images on the transfer belt 41, onto the sheet 61.

In the case of the first preferred embodiment, the direct transfer system was employed, which transfers the developer image on each photosensitive drum 311 directly onto the sheet 61. In the case of this preferred embodiment, however, the indirect transfer system was employed, which transfers the monochromatic developer images, different in color, onto the transferred belt 41, and then, transfers all at once the four developer images on the transfer belt 41, onto the sheet 61 by the secondary transfer roller 46.

As will be understood from FIG. 9, the employment of the indirect transfer system can reduce in length the conveyance passage for the sheet 61. Thus, it has a merit in that it can reduce the length of time necessary for image formation, by the amount proportional to the amount by which the sheet conveyance passage is reduced.

<Unitization of Components with Limited Service Life, and Consumables>

Figure 10:
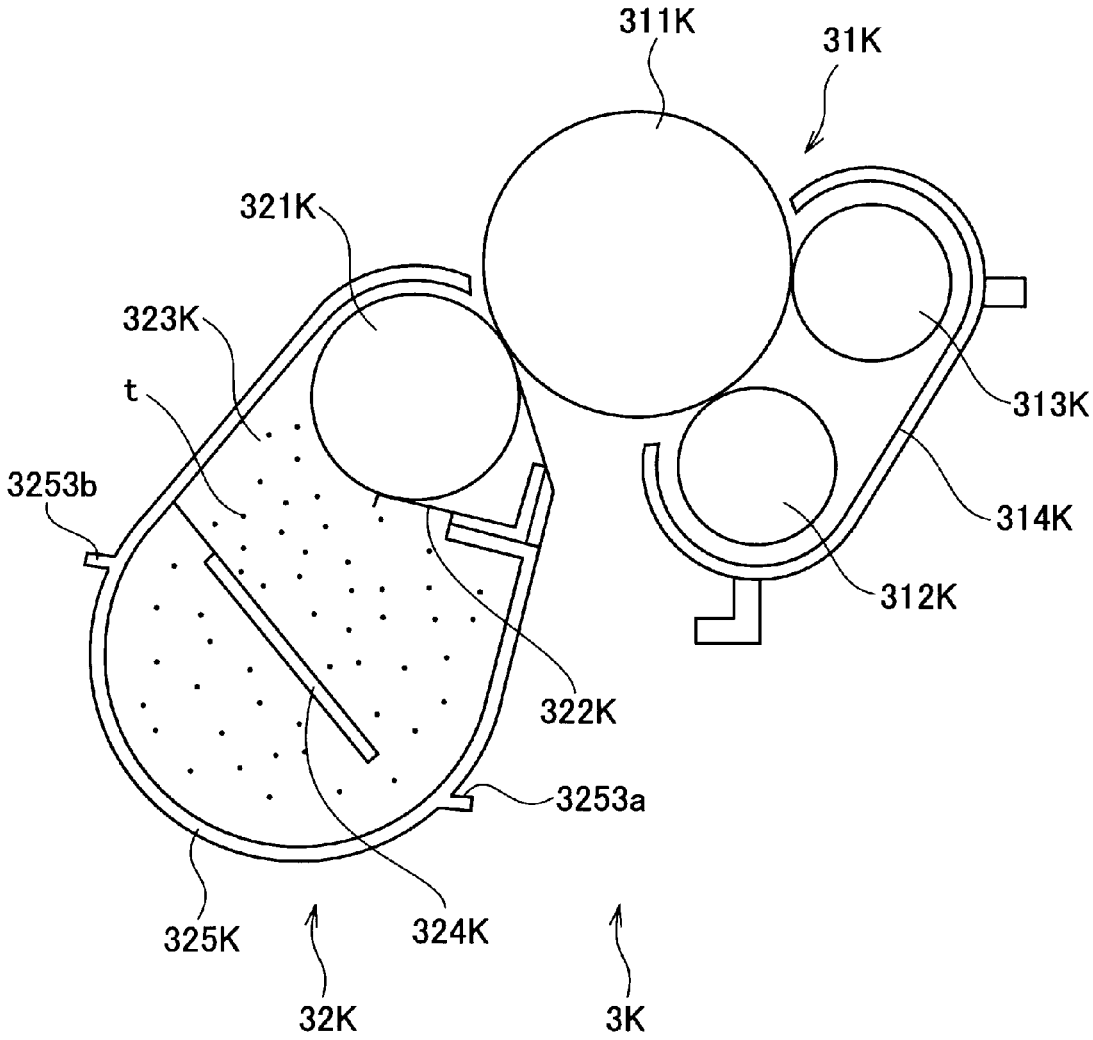
FIG. 10 is a cross-sectional view of the image forming portion of the image forming apparatus in FIG. 9, and shows the structure of the image forming portion.
Figure 11:
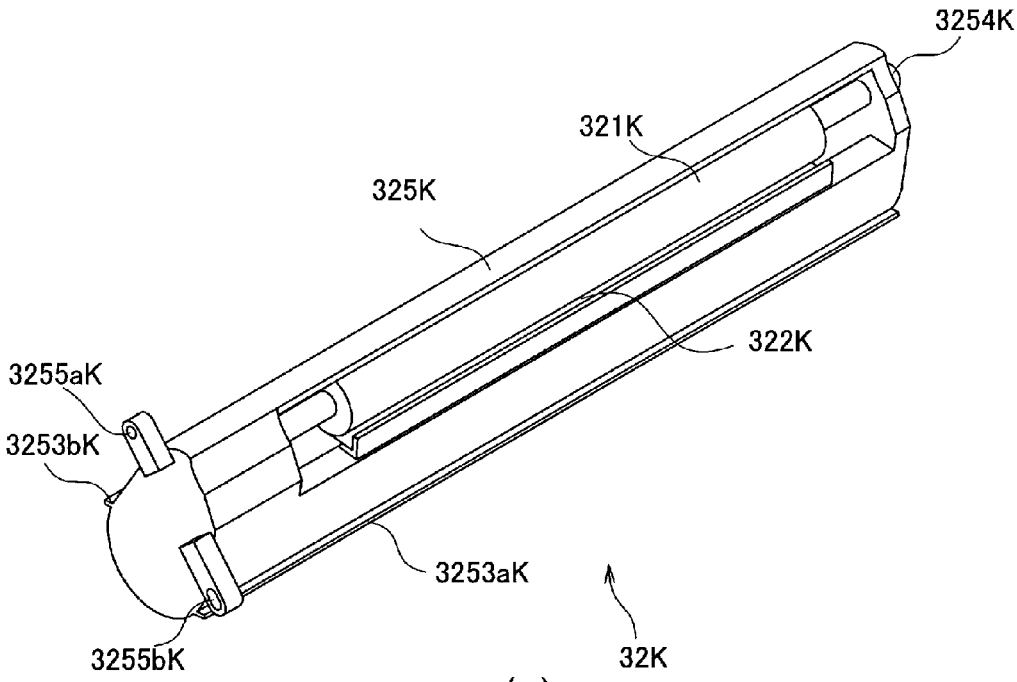
FIG. 11 is perspective views of one of the development cartridges, and one of the drum cartridges, respectively, in the second preferred embodiment.
Figure 11:
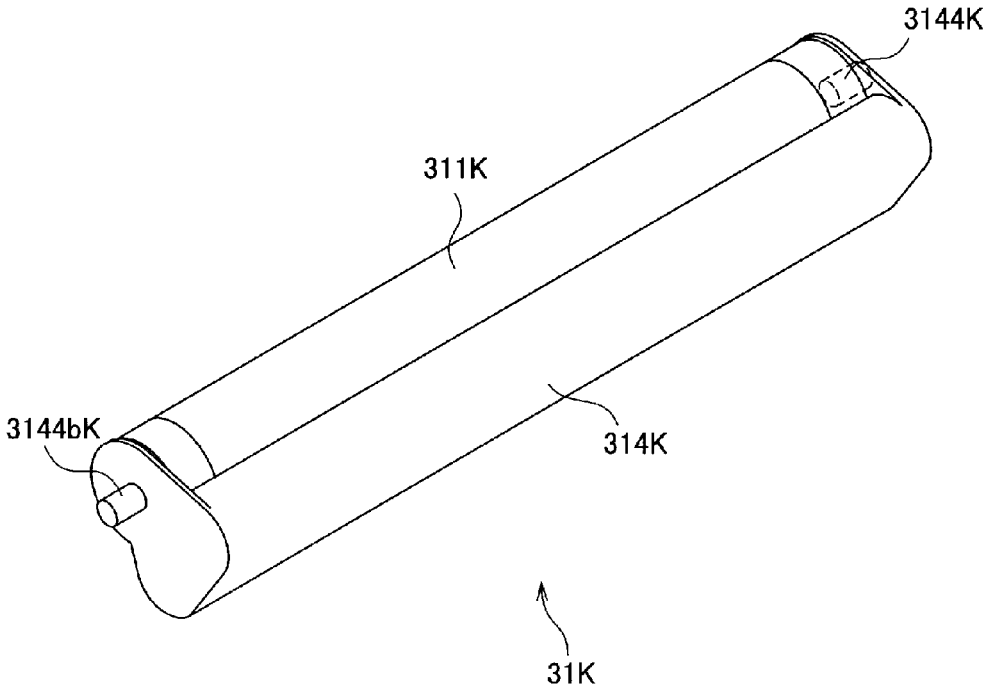

Also in this preferred embodiment, each image forming portion 3 is made up of the drum cartridge 31 and development cartridge 32. Next, referring to FIGS. 10 and 11, the image forming portion 3 in this embodiment will be described. FIG. 10 is a cross-sectional view of one of the image forming portions in the second preferred embodiment, and shows the general structure of the image forming portion. FIG. 11(*a*) is a perspective view of one of the development cartridges 32 in the second preferred embodiment. FIG. 11(*b*) is a perspective view of one of the drum cartridges 31 in the second preferred embodiment.

The frame 325 of the cartridge 32 is provided with a pair of cartridge guides 3253*a* and 3253*b*, that is, the portions by which the cartridge 32 is guided when the cartridge 32 is mounted or dismounted. Further, the cartridge 32 is provided with a cartridge positioning rear boss (by which cartridge is positioned) 3254, and a pair of cartridge positioning front holes (by which cartridge is precisely positioned) 3255*a* and 3255*b* (FIG. 11(*a*)).

Further, the cartridge 31 is provided with a pair of cartridge supporting shafts (by which cartridge is guided and positioned) 3144*a* and 3144*b* (FIG. 11(*b*)).

<Tray Unit>

Figure 12:
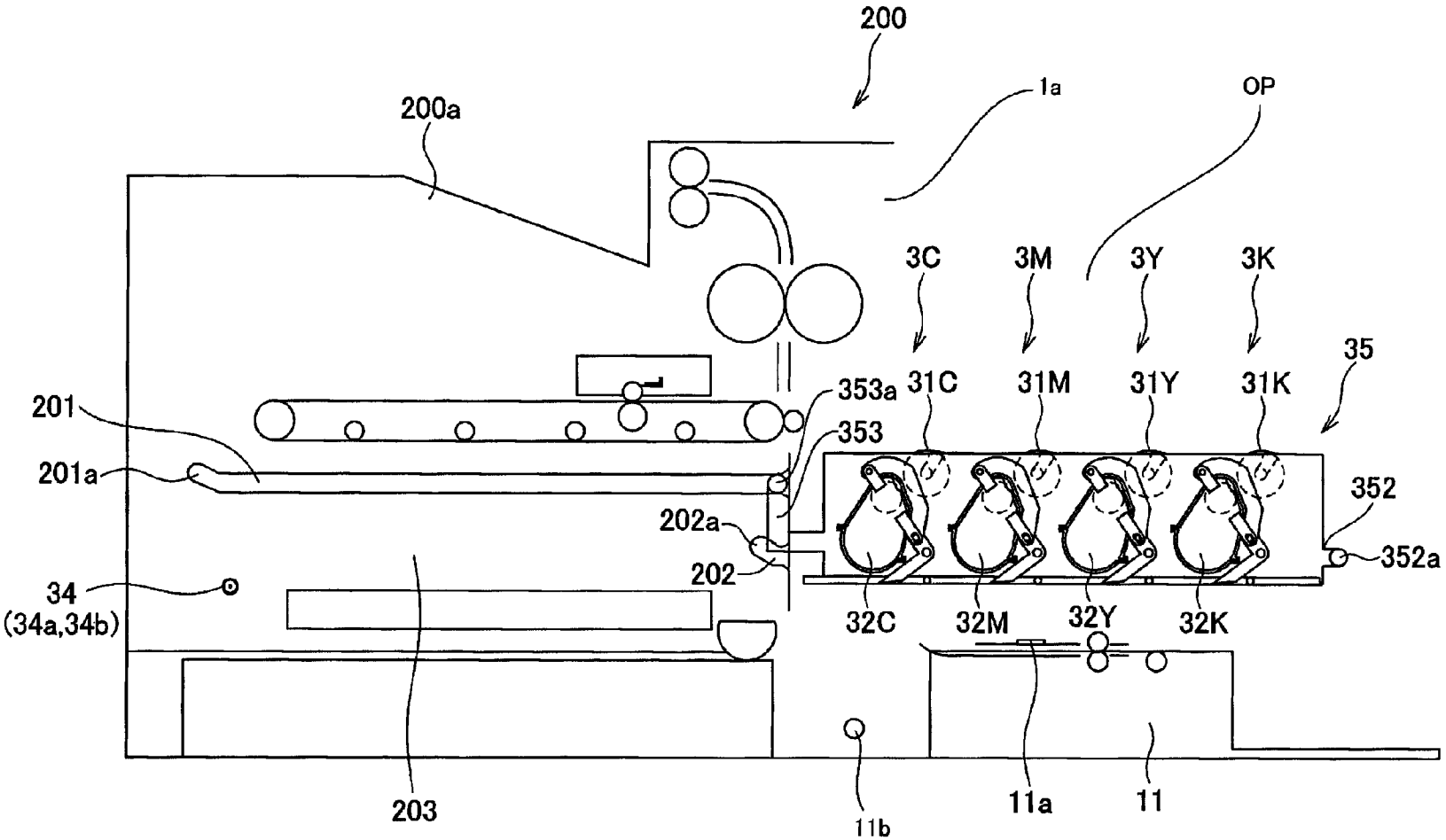
FIG. 12 is a sectional view of the image forming apparatus in the second preferred embodiment, the supporting member of which is in its outermost position relative to the main assembly of the apparatus.
Figure 13:
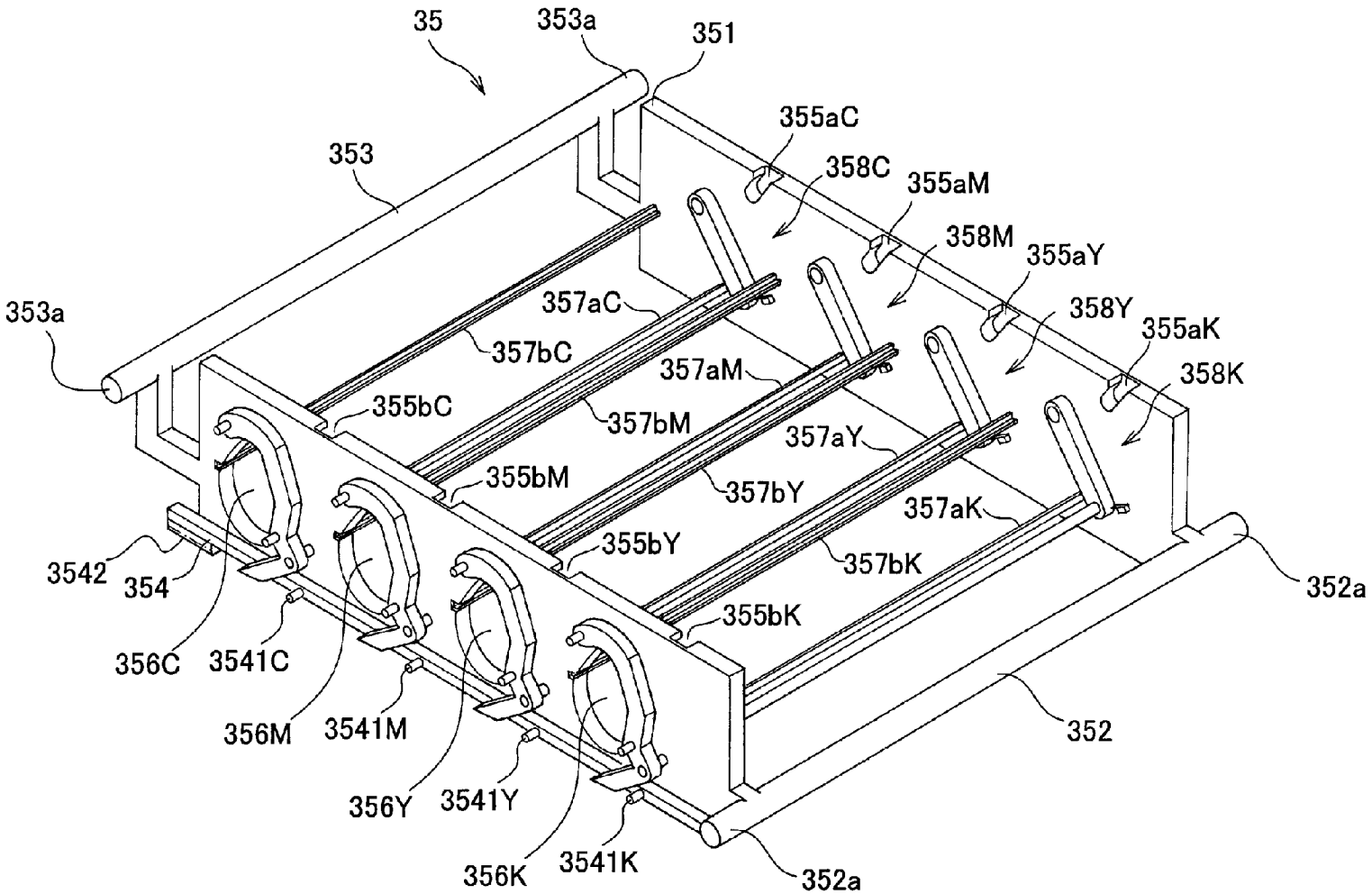
FIG. 13 is a perspective view of the supporting member in the second preferred embodiment.

Next, referring to the appended drawings, in particular, FIGS. 12 and 13, the tray unit (supporting member) 35 will be described. FIG. 12 is a schematic sectional view of the image forming apparatus in the second embodiment, when the supporting member of the image forming apparatus is at its outermost position relative to the main assembly of the apparatus. FIG. 13 is a perspective view of the tray unit in the second preferred embodiment of the present invention. Incidentally, the unit 35 is the same as the unit 33 in the first preferred embodiment, except for the structural portions which will be described next.

The tray unit (supporting member) 35 in this embodiment has a tray frame 351, and a pair of handholds 352 and 353, which are to be grasped by a user when the unit 35 is moved by the user relative to the main assembly 1. The handhold 352 is provided with a pair of tray guiding bosses 352*a* and 352*b* (by which tray unit is precisely positioned), which are at the lengthwise ends of the handhold 352, one for one. The handhold 353 is provided with a pair of tray guiding bosses 353*a* and 353*b* (by which tray unit is precisely positioned), which are at the lengthwise ends of the handhold 353, one for one (FIG. 13).

As for the main assembly 200*a*, it is provided with a pair of inner walls 203, as is the main assembly 1 in the first preferred embodiment is provided with the pair of inner walls 201. The pair of inner walls 203 oppose each other across the space in which the unit 35 is when the unit 35 is in its innermost position IP. The inner walls 203 are provided with a pair of tray guiding rails 201 and 202, respectively, which guide the tray unit 35 when the unit 35 is moved from its innermost position IP to its outermost position OP (FIG. 12), or from the outermost position OP to the innermost position IP. Further, the guide rails 201 and 202 are provided with a pair of tray positioning portions 201*a* and 202*a* (of unit 35). Further, a cover 11 is provided with a tray contacting portion 11*a* for keeping the unit 35 precisely positioned in the innermost position IP (FIG. 12).

If a user wants to move the unit 35 from its outermost position OP to its innermost position, the user is to move the unit 35 by grasping the handhold 352. As the unit 35 is moved toward the innermost position IP, the guiding bosses 353*a* and 352*a* of the unit 35 engage with the guide rails 201 and 202, respectively, of the main assembly 200*a*, whereby the unit 35 is regulated in movement. Therefore, it is ensured that the unit 35 is precisely moved. As the user moves the unit 35 to the innermost position IP, the pair of guide bosses 352*a* and 353*a* reach the pair of tray positioning portions 202*a* and 203*a*, respectively. Then, the closing of the cover 11 causes the tray contacting portion 11*a* to come into contact with the guide bosses 352*a*, whereby the unit 35 is precisely positioned in the innermost position IP (FIG. 9).

Further, the unit 35 is provided with a separation bar 354, which is one of the structural components of the means for placing each development roller 321 in contact with, or separating each development roller 321 from, the corresponding photosensitive drum 311.

Further, the unit 35 is provided with a pair of drum cartridge guides 355*a* and 355*b*, which are a pair of grooves for guiding the cartridge 31 when the cartridge 31 is mounted into, or dismounted from, the unit 35.

Further, the unit 35 is provided with four development cartridge accommodating openings 356, through which the cartridges 32 are inserted into, or pulled out of, the unit 35. The unit 35 is also provided with four pairs of guide rails 357*a* and 357*b*, which guide the cartridges 32 when the cartridges 32 are mounted into the unit 35.

Further, the unit 35 is provided with a means (mechanism) 358 for placing each cartridge 32 (development roller 321) in contact with, or separating each cartridge 32, from the corresponding photosensitive drum 311.

Figure 14:
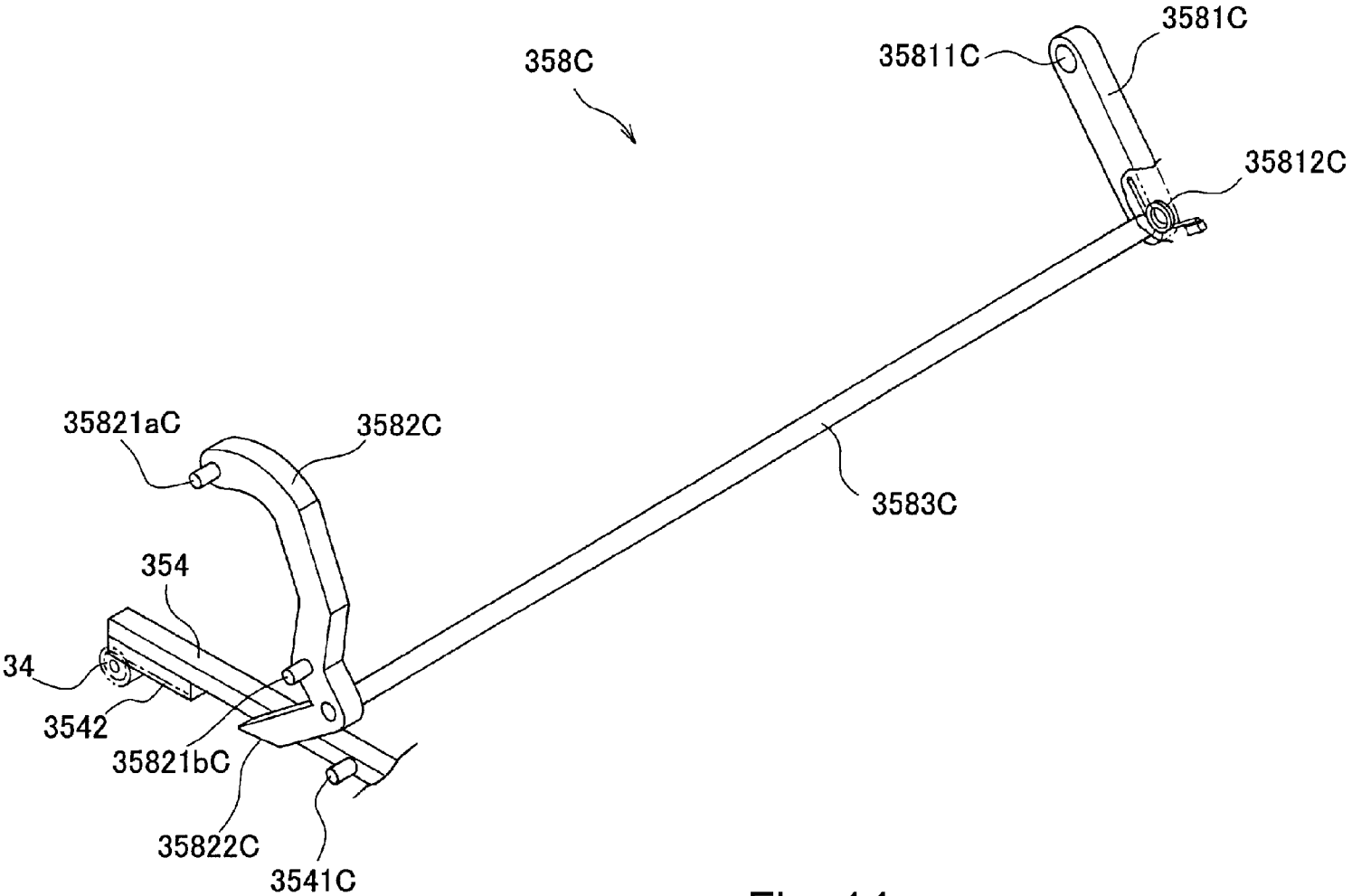
FIG. 14 is a perspective view of the mechanism for placing the development cartridges in contact with the corresponding photosensitive drums, or separating the development cartridges from the corresponding photosensitive drum, in the second preferred embodiment.

At this time, referring to FIG. 14, the means 358 for placing each cartridge 32 in contact with, or separating each cartridge 32 from, the photosensitive drum 311, will be described. Hereafter, the means 358 may be referred to as a cartridge moving means 358. FIG. 14 is a perspective view of the cartridge moving means mechanism (cartridge moving means) in the second preferred embodiment of the present invention. The four portions of the cartridge moving means 358 are the same in structure. Therefore, the cartridge moving means portion for the cartridges 31C and 32C will be described as an example of the four portions.

The essential components of the cartridge moving means 358 are an oscillatory rear cam 3581, an oscillatory front cam 3582, and a shaft 3583. The shaft 3583 connects the oscillatory rear cam 3581 to the oscillatory front cam 3582, and its axial line coincides with the rotational axes of the oscillatory rear and front cams 3581 and 3582.

The cam 3581 is provided with a cartridge positioning rear hole 35811, which engages with the cartridge positioning rear boss 3254 of the cartridge 32. The cam 3582 is provided with a pair of cartridge positioning front bosses 35821*a* and 35821*b*, which engage with a pair of cartridge positioning front holes 3255*a* and 3255*b* of the cartridge 32. Further, the cam 3582 is provided with a contact portion 35822, which engages with a separation bar pin 3541 (FIG. 13) with which the separation bar 354 is provided. This structural arrangement is the same for all of the other pairs of cartridges 31 and 32.

<Mounting of Cartridges into Tray Unit, and Dismounting of Cartridges from Tray Unit>

Next, referring to FIGS. 11(*a*) and 11(*b*), and FIGS. 13-16, the method for mounting each cartridge 32 and each cartridge 31 into the unit 35, and the method for dismounting each cartridge 32 and each cartridge 31 from the unit 35, will be described.

When a user wants to insert a cartridge 32 into the unit 35 (supports cartridge 32 by unit 35), the user is to insert the cartridge 32 into the unit 35 through the opening 356, so that the lengthwise end portion of the cartridge 32, which has the boss (cartridge positioning portion) 2354, enters the unit 35 first. It is important that the cartridge 32 is inserted into the unit 35 in the direction parallel to the axial line (lengthwise direction) of the development roller 321 while the cartridge 32 is held in such a manner that the pair of guides (by which cartridge is guided) 3253*a* and 3253*b* align with the guide rails (cartridge guiding portions) 357*a* and 357*b*, respectively.

As the cartridge 32 is inserted far enough into the deepest end of the unit 35 for the leading end of the cartridge 32 reach the rear end of the unit 35, the boss 3254 fits into the cartridge positioning rear hole (cartridge positing portion of unit 35) 35811, with which the cam 3581 is provided. During this movement of the cartridge 32, the bosses 35821*a* and 35821*b*, with which the cam 3582 is provided, fit into the holes 3255*a* and 3255*b* of the cartridge 32, respectively, which ends the mounting of the cartridge 32 into the unit 35; that is, the cartridge 32 is fully supported by the unit 35 (FIG. 15(*b*)).

Then, the unit 35 is to be moved from its outermost position OP to its innermost position IP while the cartridges 32 remain mounted in the unit 35. As the unit 35 is moved into its innermost position IP, the development cartridge frame (cartridge positioning portion of development cartridge 32) 325 comes into contact with the inner walls (cartridge positioning portion of main assembly 200*a*) 203, whereby the cartridge 32 is precisely positioned relative to the main assembly 200*a* in terms of its lengthwise direction.

If a user wants to take any of the cartridges 32 out of the unit 35, all that the user has to do is to pull the cartridge 32 in the direction perpendicular to the axial line of the development roller 321, through the opening 356, after moving the unit 35 into its outermost position OP.

Figure 15:
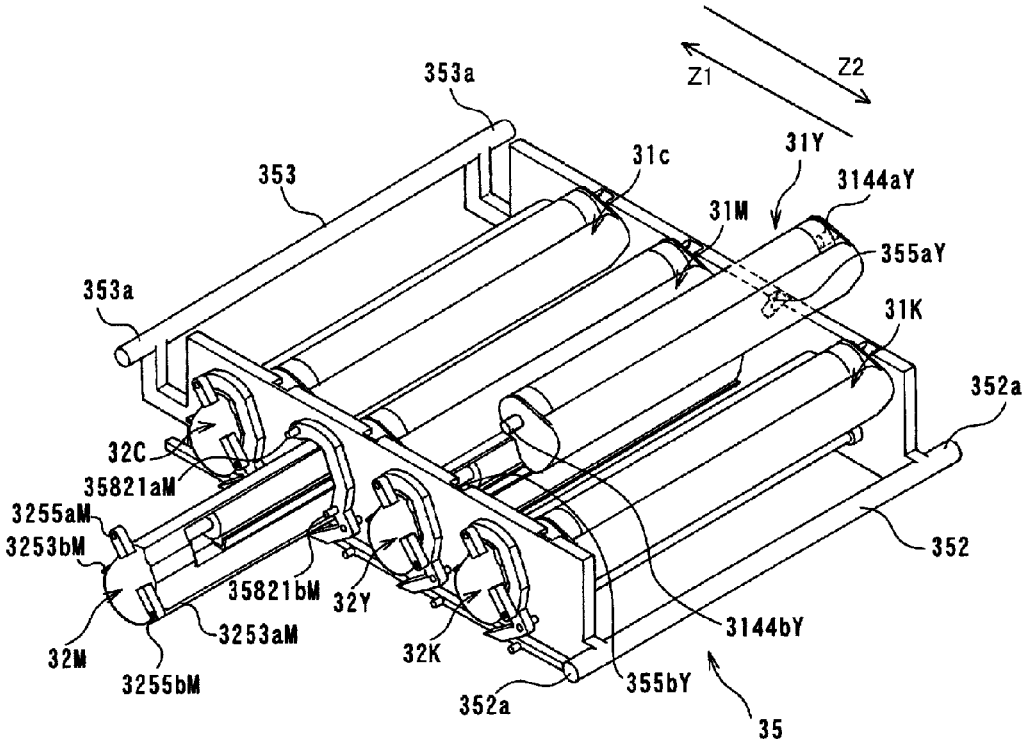
FIG. 15 is a perspective view of the supporting member, and the cartridges on the supporting member, in the second preferred embodiment, and shows the positional relationship between the supporting member and the cartridges.
Figure 15:
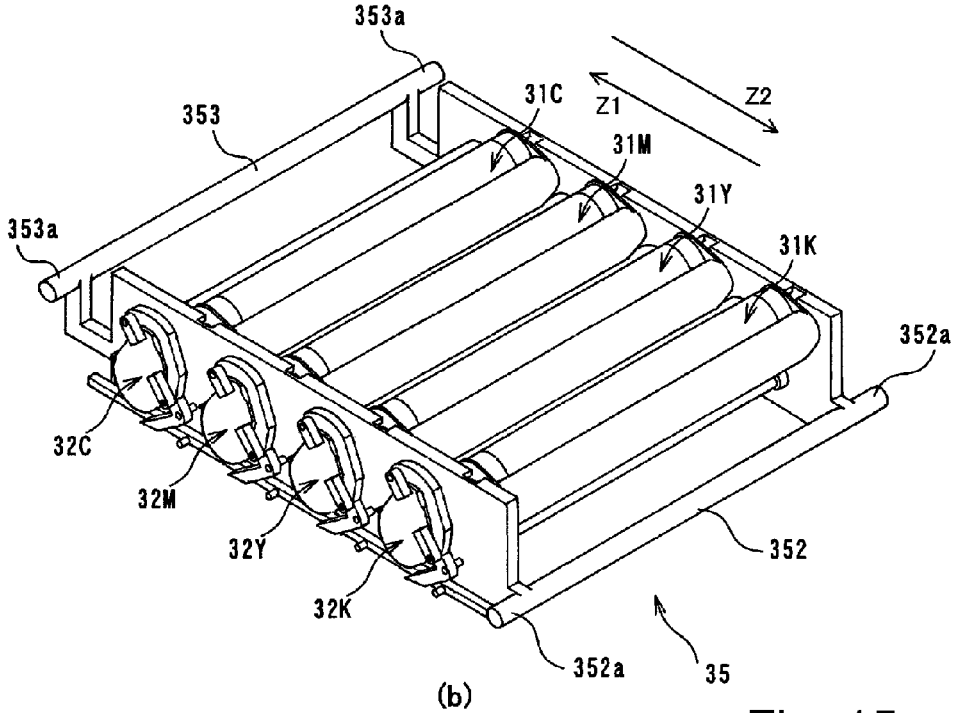

Incidentally, FIG. 15(*a*) shows the cartridge 32M, as an example of cartridge 32 which is being mounted into, or removed from, the unit 35.

On the other hand, if a user wants to mount any of the cartridges 31 into the unit 35 (support cartridge with unit 35), the first step for the user to take is to align the supporting shafts (portions by which drum cartridge 31 is guided and positioned) 3144*a* and 3144*b*, with which the lengthwise ends of the cartridge 31 are provided, one for one, with the drum cartridge guides (drum cartridge guiding portions) 355*a* and 355*b*, respectively. Then, the user is to mount the cartridge 31 into the unit 35 so that the supporting shafts 3144*a* and 3144*b* follow the pair of guides 355*a* and 355*b*, respectively. The mounting of the cartridge 31 into the unit 35 makes the cartridge 31 fully supported by the unit 35 while remaining precisely positioned relative to the unit 35 (FIG. 15(*b*)).

That is, the user is to move the cartridge 31 vertically downward toward the unit 35 from above the unit 35 so that the cartridge 31 snugly falls into the unit 35. As the cartridge 31 snugly falls into the unit 35, it is fully supported by the unit 35 while being precisely positioned relative to the unit 35 (FIG. 15(*b*)). If the user wants to take any of the cartridges 31 out of the unit 35, all that is necessary for the user to do is to move the cartridge 31 vertically upward, after moving the unit 35 into its outermost position OP.

Incidentally, FIG. 15(*a*) depicts the cartridge 31Y, as an example of cartridge 31, which is being mounted into, or removed from, the unit 35.

<Direction in which Cartridge is Mounted into Tray Unit, and Direction in which Cartridge is Dismounted from Tray Unit>

As described above, in this embodiment, the image forming apparatus 200 is structured so that each of the cartridges 31 and 32 can be independently mounted into, or removed from, the unit 35, from the other cartridges. Further, the image forming apparatus 200 is structured so that each cartridge 31 is paired with the corresponding cartridge 32, and multiple (four) pairs of cartridge 31 and 32 are aligned in parallel in the directions (indicated by arrow marks Z1 and Z2) in which the unit 35 is movable; each pair of cartridges 31 and 32 are supported by the unit 35 so that their lengthwise directions are intersectional (perpendicular) to the abovementioned moving directions Z1 and Z2 of the unit 35. Each cartridge 31 and each cartridge 32 are supported by the unit 35 so that the lengthwise direction of each cartridge 31 and the lengthwise direction of each cartridge 32 are intersectional (perpendicular) to the directions Z1 and Z2, in which the unit 35 is moved (FIGS. 15(*a*) and 15(*b*)).

Further, the image forming apparatus 200 (unit 35) is structured so that the direction in which each cartridge 31 is mounted into, or removed from, the unit 35, is different from the direction in which each cartridge 32 is mounted into, or removed from, the unit 35. That is, the image forming apparatus 200 (unit 35) is structured so that the direction in which each cartridge 31 is mounted into, or removed from, the unit 35 is, perpendicular to the direction in which each cartridge 32 is mounted into, or removed from the unit 35. Further, the image forming apparatus 200 (unit 35), each cartridge 31, and each cartridge 32 are structured so that each cartridge 31 and 32 can be independently mounted into, or removed from, the unit 35, from the other cartridges. More concretely, the image forming apparatus 200 (unit 35) is structured so that each cartridge 32 is to be mounted or dismounted in the direction which is roughly vertical and is perpendicular to the axial line of the development roller 321, whereas, each cartridge 31 is to be horizontally mounted or dismounted in the direction parallel to the axial line of the photosensitive drum 311. It should be noted here that while any pair of cartridges 31 and 32 remains properly situated (supported) in the unit 35, the axial lines of the photosensitive drum 311 and development roller 321 in the cartridge are parallel to each other.

Further, as described above, the image forming apparatus 200 is structured so that while the main assembly 200*a* is on a horizontal surface, the unit 35 is horizontally movable, and also, so that the direction in which each cartridge 32 is mounted into, or dismounted from, the unit 35, is horizontal, and is perpendicular to the direction in which the unit 35 is movable.

With the provision of the above described structural arrangement, while the main assembly 200*a* remains positioned on a horizontal surface, the moving direction of the unit 35 is perpendicular to the direction in which each cartridge 31 is mounted into, or dismounted from, the unit 35. The moving direction of the unit 35 is roughly perpendicular to the direction in which each cartridge 32 is mounted into, or dismounted from, the unit 35.

In order to minimize in size the main assembly 200*a* of the image forming apparatus 200, the image forming apparatus 200 in this embodiment is structured so that while the main assembly 200*a* remains on a horizontal surface, each cartridge 32 and the corresponding cartridge 31 partially overlap each other in terms of the vertical direction.

Figure 16:
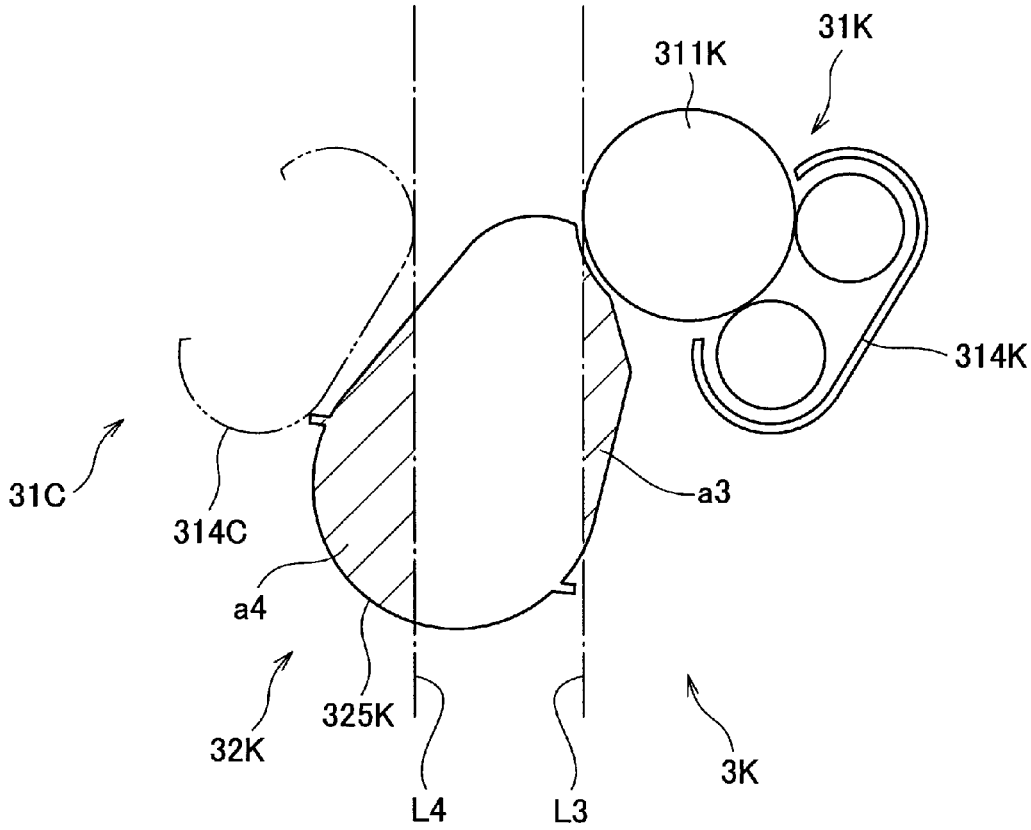
FIG. 16 is a schematic drawing for describing the positional relationship between one of the drum cartridges, and the corresponding development cartridge, in the second preferred embodiment.

Next, referring to FIG. 16, the abovementioned setup will be described. FIG. 16 shows the cartridge 31C and 31K. The cartridge 32K is extending beyond the area sandwiched by two lines L3 and L4, that is, the maximum gap between the cartridges 31C and 31K, by its hatched portions a3 and a4 in the drawing. In other words, the image forming apparatus 200 is structured so that the cartridge 32K fits into the space between the bottom portions of the adjacent two cartridges 31K and 31C.

That is, while the two cartridges 31 and 32 remain properly mounted (supported) in the unit 35, a part of the cartridge 32 remains under the cartridge 31, reducing in size the space for supporting (mounting) the cartridges 31 and 32. Thus, this setup can reduce in size the main assembly 200*a*.

Even though the image forming apparatus 200 (unit 35) in this embodiment is structured so that while the cartridges 31 and 32 remain properly supported in the unit 35, a part of each cartridge 32 is positioned below the corresponding cartridge 31, the cartridges 31 and 32 are not affected in terms of the efficiency with which they can be mounted or dismounted, because the image forming apparatus 200 (unit 35) in this embodiment is also structured so that the direction in which each cartridge 31 is mounted or dismounted is perpendicular to the direction in which each cartridge 32 is mounted or dismounted. The employment of this structural arrangement makes it possible for each of the cartridges 31 and 32 to be independently mounted into, or dismounted from, the unit 35, from the other cartridges. In other words, it is possible to exchange only the cartridge which needs to be replaced.

<Mechanism for Placing Development Roller in Contact with Photosensitive Drum, and Separating Development Roller from Photosensitive Drum>

Next, referring to FIGS. 9, 14, and 17, the means (mechanism) (which hereafter will be referred to as development roller moving means (mechanism)) for placing the development roller in contact with, or separating from, the photosensitive drum, will be described. FIGS. 17A, 17B, and 17C are drawings for describing the working of the development roller moving means in the preferred embodiment of the present invention, and are side views of the unit 35, as seen from the side where the openings 356 are present.

Referring to FIG. 14, a pair of cams 3581 and 3582 are connected to each other with an oscillatory shaft 3583, and are attached to the unit 35 so that they can be oscillatory moved. The cartridge 32 is supported by the pair of cams 3581 and 3582, as described above. Thus, the cartridge 32 is supported so that it can be oscillatory rotated about the axial line of the oscillatory shaft 3583. Further, the cam 3581 is provided with a torsional coil spring (elastic member) 35812, which is disposed within the cam 3581, as shown in FIG. 14.

On the other hand, the main assembly 200*a* is provided with a separation gear 34, as shown in FIG. 9. Further, the image forming apparatus 200 is structured so that as the unit 35 is moved into its innermost position IP in the main assembly 200*a*, the rack portion 3542, with which one of the lengthwise ends of the separation bar 354 is provided, meshes with the separation gear 34.

Also in this embodiment, the separation gear 34 is rotatable by a driving means M, only by a preset angle, as was the separation gear in the first preferred embodiment. The rotation of the gear 34 is controllable by a controlling means C, making it possible to move the separation bar leftward or rightward in FIG. 17.

Figure 17A:
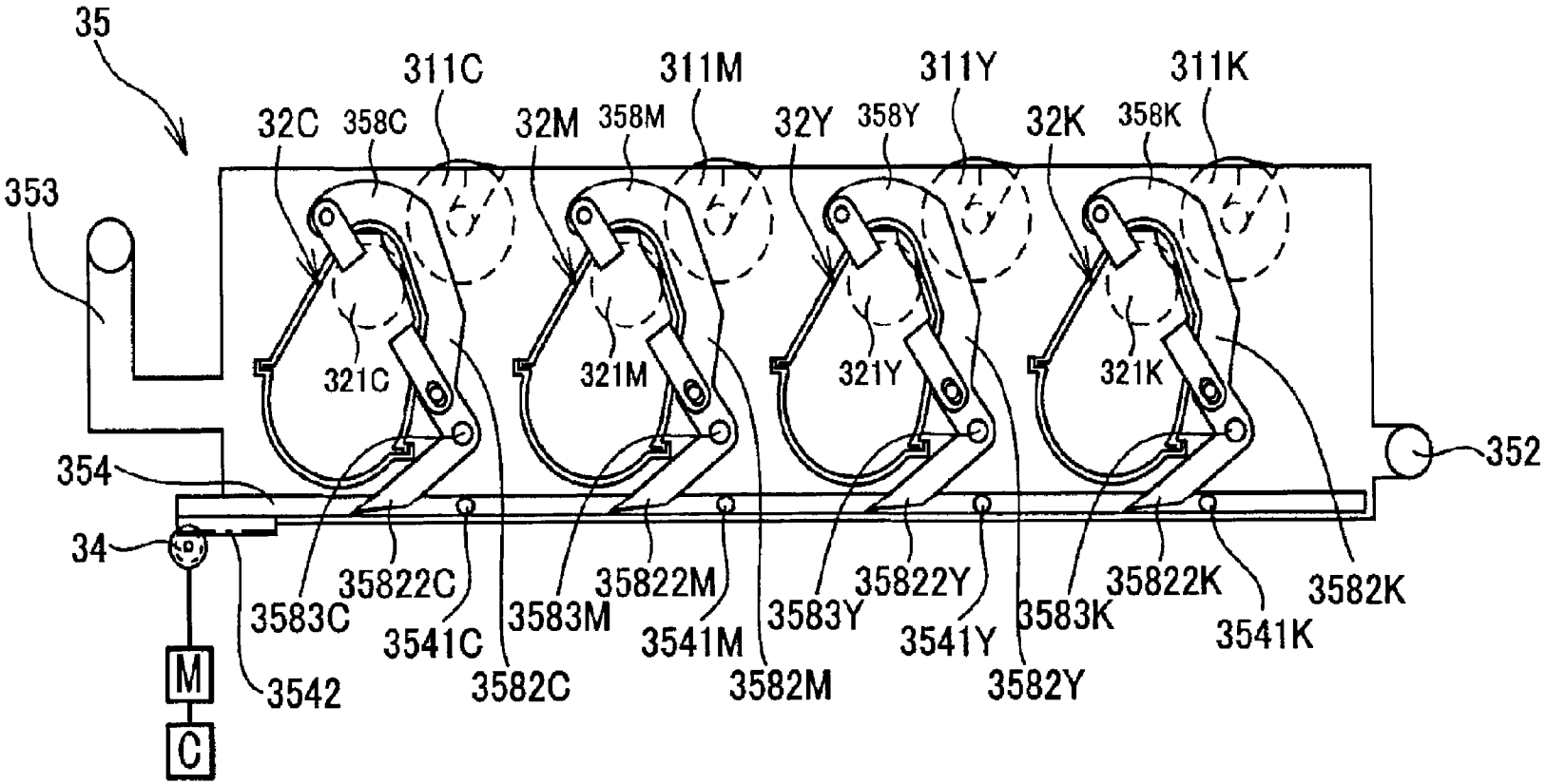
FIG. 17A, FIG. 17B and FIG. 17C illustrate the mechanism for placing the development cartridges in contact with the corresponding photosensitive drums, or separating the development cartridges from the corresponding photosensitive drums.
Figure 17B:
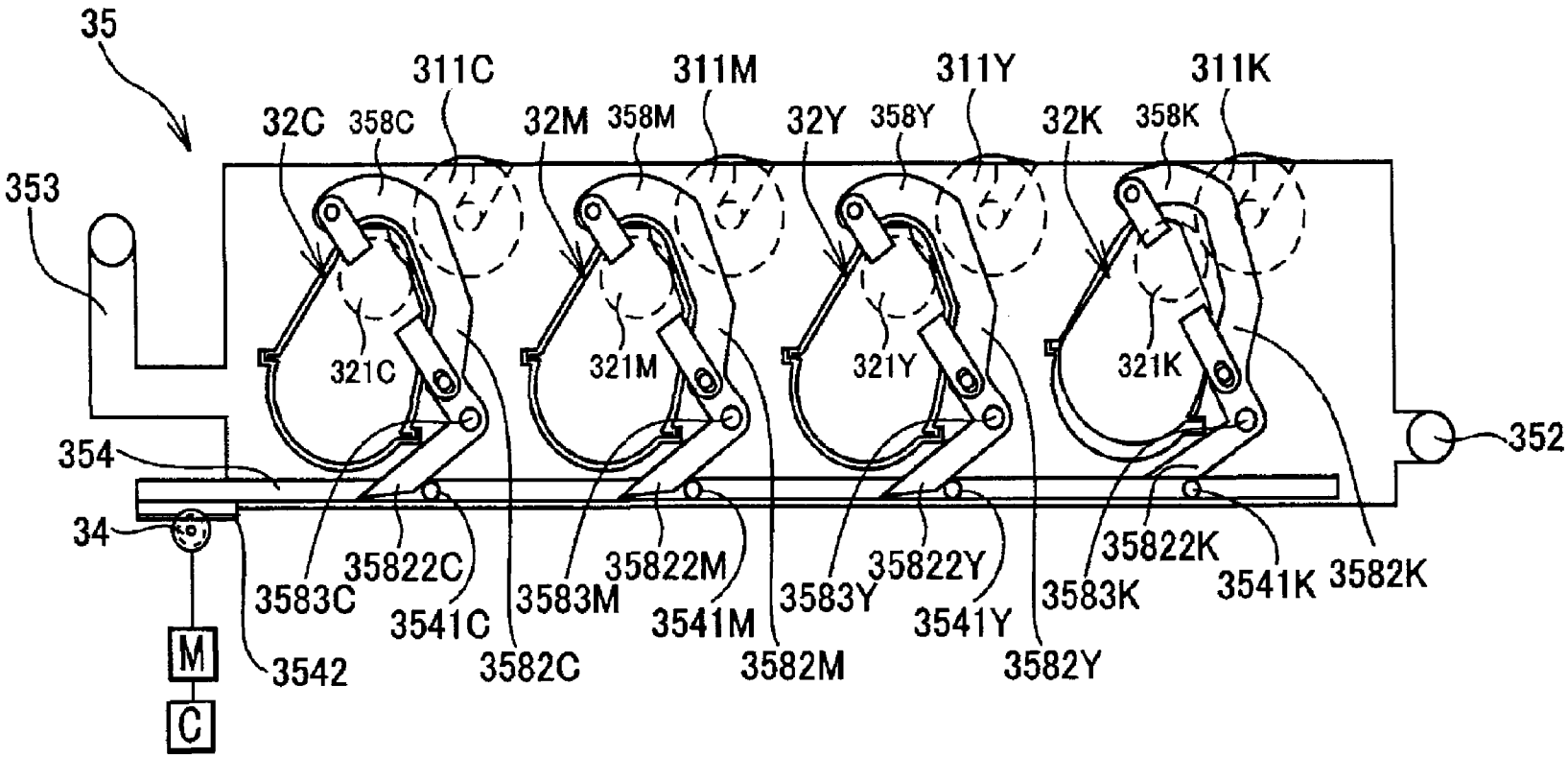
Figure 17C:
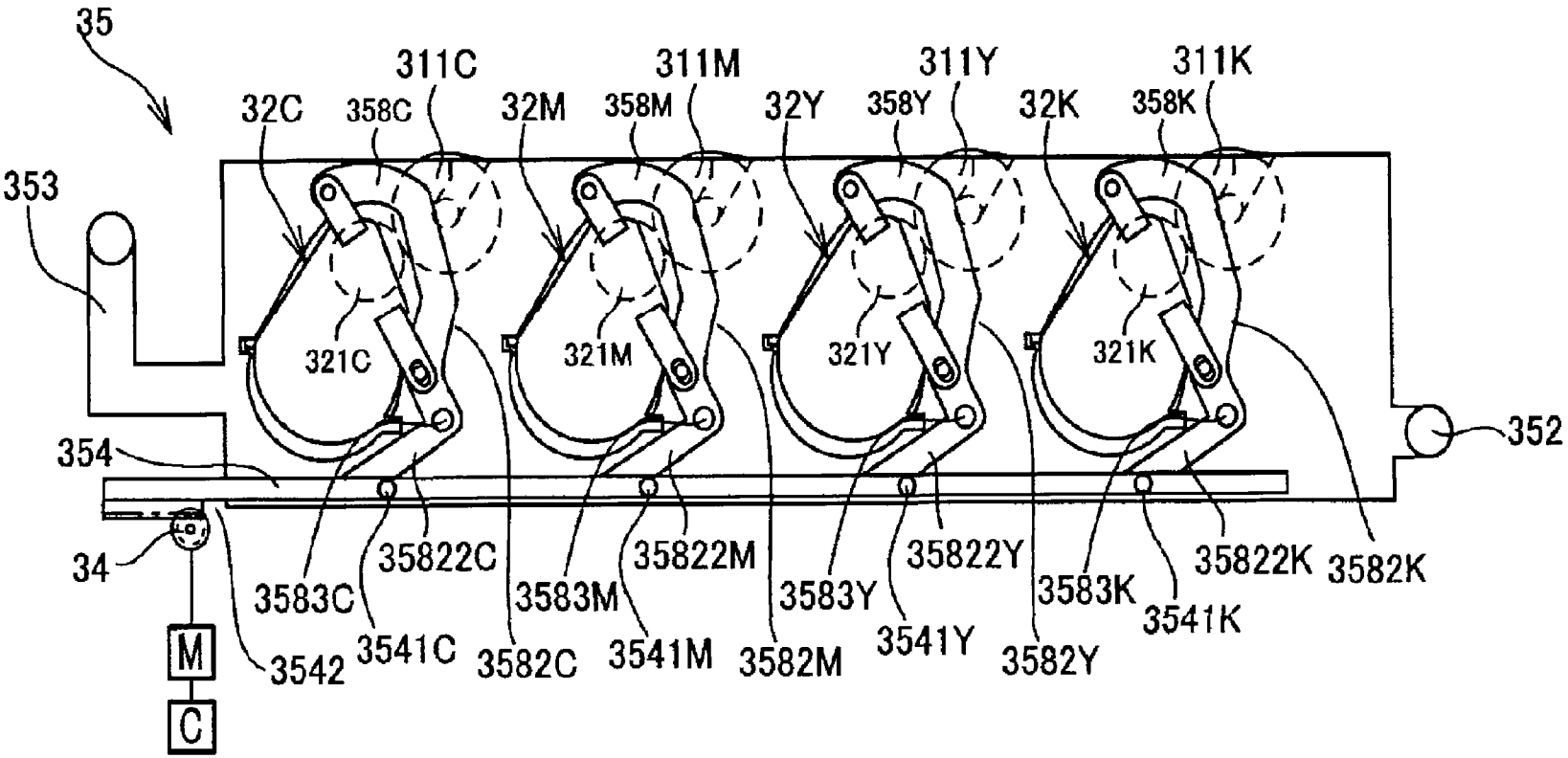

FIG. 17 shows the various positional relationships among the cartridge moving means 358, cartridge 32, and photosensitive drum 311. FIG. 17A shows the combination of the unit 35 and cartridges 31 and 32, when all the development rollers 321 of all the cartridges 32 are remaining separated from the corresponding photosensitive drums 311. FIG. 17B shows the combination of the unit 35 and cartridges 31 and 32, when only the cartridge 32K is in its development position, in which it remains in contact with the corresponding photosensitive drum 311, that is, the drum 311K. FIG. 17C shows the combination of the unit 35 and cartridges 31 and 32, when all the cartridge 32 are in contact with the corresponding photosensitive drums 311, that is, all the development rollers 321 are in their development positions in which they remain in contact with the corresponding drums 311, one for one.

Referring to FIG. 17A, right after the complete insertion of the unit 35 into the main assembly 200*a*, all the cartridges (development roller 321) remain separated from the corresponding photosensitive drums 311, because the cam 3581 is kept pressured in the counterclockwise direction by the resiliency of the spring (elastic member) 35812.

Then, as the gear 34 is rotated in the counterclockwise direction (FIG. 17), the separation bar 354 is moved leftward. As the separation bar 354 is moved leftward, first, the separation bar pin 3541K, which corresponds to the cartridge 32K, comes into contact with the contact portion 358 of the cam 3582K. Then, as the separation bar is moved further leftward, the separation bar pin 3541K moves upward, causing thereby the cam 3582K and oscillatory shaft 3583K to rotate clockwise about the axial line of the oscillatory shaft 3583K. Thus, the cam 3581K attached to the oscillatory shaft 3583K also rotates clockwise. As a result, the development cartridge 32K rotates clockwise about the axial line of the oscillatory shaft 3583K.

Thus, the cartridge 32K (more specifically, development roller 321K) comes into contact with the photosensitive drum 311K. That is, the development roller 321K moves into its development position, as shown in FIG. 17B.

During this movement of the cartridge 32K, the pins 3541 other than the pin 3541 which corresponds to development cartridge 32K are not in contact with the corresponding cams 3582. Therefore, the development rollers 321 of these cartridges 32 remain separated from the corresponding photosensitive drums 311.

As the gear 34 is rotated further, the bar 354 is moved further leftward, causing the pins 3541 which correspond to the cartridges 32Y, 32M, and 32C to come into contact with the contact portions 35822, causing thereby the cams 3582 to rotate clockwise (FIG. 17). As a result, the cartridges 32Y, 32M, and 32Y are rotationally moved in the clockwise direction about the axial lines of the oscillatory shafts 3583.

Consequently, the cartridges 32Y, 32M, and 32C also come into contact with the corresponding photosensitive drums 311, one for one, as shown in FIG. 17C. That is, the development rollers 32, which these cartridges 32 have, come into contact with the photosensitive drums 311, one for one. Since the pin 3541K of the cartridge 32K remains in contact with the contact portion 35822K, the cartridge 32K remains in contact with the photosensitive drum 311K. That is, the development roller 321K, which the cartridge 32K has, remains in contact with the photosensitive drum 311K.

Further, as the gear 34 is rotated clockwise (FIG. 17) while the combination of the unit 35 and cartridges 32 and 31 are in the state shown in FIG. 17C, the bar 354 is moved rightward by the rotation of the gear 34. Thus, the state of the combination changes to the state shown in FIG. 17B, and then, to the state shown in FIG. 17A.

As described above, the development roller 321, which each cartridge 32 has, is placed in contact with, or separated from, the corresponding photosensitive drum 311 by controlling the rotation of the gear 34 with the use of the controlling means C. If a user wants to form a color image, all that is necessary for the user to do is to put the combination of the unit 35 and cartridges 32 and 31 in the state shown in FIG. 17C.

On the other hand, if a user wants to form only black-and-white images, the user has only to put the combination in the state shown in FIG. 17B. Placing only the cartridge 32K (development roller 321K) in contact with the photosensitive drum 311 to prevent the photosensitive drums 311, which the cartridges 31Y, 31M, and 31C have, and the development rollers 321, which the cartridges 32Y, 32M, and 32C have, from being unnecessarily worn.

Also as described above, in a case where the teeth of the gear 34 are not in mesh with the rack portion of the bar 334, the bar 334 is kept in its rightmost position by the resiliency of the spring 35812, as shown in FIG. 17A.

That is, while the unit 33 is completely out of the main assembly 200*a*, the teeth of the gear 34 are not in mesh with the rack portion of the bar 334. Therefore, all the development rollers 321 remain separated from the corresponding photosensitive drums 311. Therefore, it does not occur that when the cartridge 31 and/or cartridge 32 is mounted or dismounted, the development roller 321 and/or photosensitive drum 311 is damaged by the contact between them.

In each of the above described preferred embodiments, the development position is the position of the development roller 321, in which the development roller is in contact with the corresponding photosensitive drum 311, whereas the abovementioned state of separation is the state in which a development roller 321 is not in contact with a photosensitive drum 311. However, these definitions are not intended to limit the present invention in scope. For example, the development position may be such a development roller position that makes smallest the distance between the development roller and photosensitive drum. In such a case, the state of separation means the state in which the distance between the development roller and photosensitive drum is significantly larger than the distance between the development roller and photosensitive drum when the development roller is in its development position. In other words, the present invention is satisfactorily applicable to a non-contact development system, as well as a contact development system.

<Advantages of Image Forming Apparatus in this Embodiment>

As described above, the image forming apparatus in this preferred embodiment is structured so that the direction in which the cartridge 31 is mounted into, or dismounted from, the unit 33, is perpendicular to the direction in which the cartridge 32 is mounted into, or dismounted from, the unit 33. Therefore, each cartridge 31 and each cartridge 32 can be independently mounted into, or dismounted from, the unit 35, from the other cartridges.

Further, as described above, in this embodiment, in order to minimize in size the main assembly 200*a*, the image forming apparatus 200 is structured so that while the cartridges 31 and 32 remain supported by (mounted in) the unit 35, a part of each cartridge 32 is below the adjacent cartridge 31. In spite of this structural arrangement, the image forming apparatus 200 is not inferior to any of the conventional image forming apparatuses in terms of the ease with which cartridges 31 and 32 can be mounted or dismounted.

(Miscellanies)

In each of the above described preferred embodiments of the present invention, the cartridges 31 and 32 are removably mountable in the main assembly 1 or 200*a*. Further, each of the tray units 33 and 35 is precisely positioned in its innermost position IP in the main assembly 1 or 200*a* while supporting the cartridges 31 and 32, whereby the cartridges 31 and 32 are precisely positioned in their image forming positions, in which they contribute to image formation. On the other hand, if a user wants to take any of the cartridges 31 and 32 out of the main assembly 1 or 200*a*, the user is to move the tray unit 33 or 35, which is in its innermost position IP in the main assembly 1 or 200*a* and is supporting the cartridges 31 and 32, out of the main assembly 1 or 200*a*. In other words, if it is necessary for any of the cartridges 31 and 32 in the main assembly 1 or 200*a*, to be replaced, the operation for the removal of the cartridge to be replaced from the tray unit 33 or 35, and the operation for mounting a replacement cartridge into the tray unit 33 or 35, are to be carried out after the tray unit 33 or 35 is pulled out of the main assembly 1 or 200*a*.

Strictly speaking, the "outermost position" in each of the above-described preferred embodiments does not need to be literally outermost position; it may be any position (of the unit 33 or 35) outside the main assembly 1 or 200*a*. It does not necessary mean the tray position that exposes the entirety of the tray 33 or 35. All that it means is a tray position in which the tray units 33 or 35 is out of the main assembly 1 or 200*a*, respectively, far enough for the cartridge(s) 31 and/32 in the tray units 33 or 35 to be replaced.

For example, referring to FIG. 5, the cartridge 32C supported by the most upstream portion of the unit 33, in terms of the direction (indicated by arrow mark Z2) in which the unit 33 is pulled out, may be on the inward side of the main assembly 1 relative to the opening 1*a*, for the following reason. That is, as long as the image forming apparatus 100 is structured so that as the cover 11 is opened, the portion of the main assembly 1, which is above the opening 1*a*, is exposed, a user can easily replace the cartridge 32C, because, when the tray unit 33 is in the above described position, the cartridge 32*c* is outward of its image forming position in the image forming apparatus 100, that is, it is on the front side of the image forming position, relative to the main assembly 1. As described above, the "outermost position" does not need to be such a position that when the unit 33 or 35 is in the outermost position, the entirety of the unit 33 or 35 is out of the main assembly 1 or 200*a*. Needless to say, it is preferable that the image forming apparatus is structured so that when the unit 33 is in its outermost position, even the cartridges 31C and 32C, which are supported by the most upstream portion of the unit 33, in terms of the direction (indicated by arrow mark Z2) in which the unit 33 is pulled out, are on the outward side of the opening 1*a*.

Further, in the above described preferred embodiments, the unit 33 or 35 is moved in a straight line and in parallel to the surface on which the main assembly 1 or 200*a* was placed. However, the preferred embodiments are not intended to limit the present invention in scope. For example, an image forming apparatus may be structured so that the unit 33 or 35 moves in a diagonally upward or downward in a straight line relative to the surface on which the main assembly is placed. Further, in the above described preferred embodiments, the image forming apparatus was structured so that the cartridges 31 and 32 are supported by the units 33 or 35 in such a manner that the lengthwise direction of the cartridge 31 and that of the cartridge 32 are intersectional (perpendicular) to the moving directions (Z1 and Z2) of the unit 33 and 35. However, these embodiments are not intended to limit the present invention in scope. For example, the structural arrangement that makes the cartridges 31 and 32 supported by the unit 33 or 35 in such a manner that the abovementioned lengthwise direction of the cartridges 31 and 32 is parallel to the moving direction of the unit 33 and 35 may be employed. Further, it is not mandatory that the image forming apparatus is structured so that the unit 33 or 35 is linearly moved. For example, the image forming apparatus may be structured so that the unit 33 or 35 is placed in the bottom portion of the main assembly 1 (or 200*a*) and is rotatable about the rotational axis of the unit 33 or 35. In the case of such a structural arrangement, the outermost position OP is the position outside the main assembly 1 (200*a*), into which the unit 33 (or 35) is moved out by being rotated about the abovementioned rotational axis. The innermost position IP is the position in the main assembly 1 (or 200*a*), in which the entirety of the unit 33 (or 35) is out of the main assembly 1 (or 200*a*). Also in the case of the image forming apparatus having the above described rotationally movable unit 33 (or 35), the image forming apparatus may be structured so that even when the unit 33 (or 35) is in its innermost position, a part of the unit 33 (or 35) is outside the main assembly 1 (or 200*a*).

As described above, each of the above described preferred embodiments of the present invention made it possible for each of the drum cartridges 31 and each of the development cartridges 32 to be removably and independently supportable by the tray unit (supporting member) 33 or 35, from the other cartridges 31 and 32. Further, each of the above described preferred embodiments made it possible to improve an electrophotographic image forming apparatus in the operational efficiency with which each of the drum cartridges 31 and each of the development cartridges 32 are replaceable.

While the invention has been described with reference to the structures disclosed herein, it is not confined to the details set forth, and this application is intended to cover such modifications or changes as may come within the purposes of the improvements or the scope of the following claims. This application claims priority from Japanese Patent Applications Nos. 250447/2008 and 104387/2009 filed Sep. 29, 2008 and Apr. 22, 2009, respectively, which are hereby incorporated by reference.

What is claimed is:

1. An electrophotographic image forming apparatus for forming an image on a recording material, said electrophotographic image forming apparatus comprising:

a plurality of drum cartridges each including an electrophotographic photosensitive member drum;

a plurality of developing cartridges each including a developing roller for developing an electrostatic latent image formed on said electrophotographic photosensitive drum using a developer; and a supporting member movable between an inside position and a retracted position in a state such that said supporting member supports said drum cartridges and said developing cartridges, wherein the inside position is inside a main assembly of said apparatus, and the retracted position is retracted outwardly from said main assembly of said apparatus, wherein said supporting member supports pairs of cartridges including one of said drum cartridges and one of said developing cartridges in such a manner such that said pairs are arranged in a movement direction of said supporting member, wherein said supporting member supports said drum cartridges and said developing cartridges independently demountably therefrom, wherein mounting and demounting directions of said drum cartridges relative to said supporting member and mounting and demounting directions of said developing cartridges are different from each other, and wherein said drum cartridges are larger than a maximum gap between adjacent ones of said developing cartridges in a direction perpendicular to a longitudinal direction of said drum cartridges, and said drum cartridges are supported by said supporting member in a state that a part of said drum cartridges are below said developing cartridges.

2. An apparatus according to claim 1, wherein one of the mounting and demounting directions of said drum cartridges and the mounting and demounting directions of said developing cartridges is substantially perpendicular to the moving direction of said supporting member.

3. An apparatus according to claim 2, wherein said supporting member is movable in a horizontal direction in the state that said main assembly of said apparatus is set on a horizontal surface, wherein, in the state that said supporting member is in the retracted position, said drum cartridges are detachably mountable in a direction that is along said supporting member and that is substantially perpendicular to the moving direction of said supporting member, and wherein, in the state that said supporting member is in the retracted position, said developing cartridges are mountable to said supporting member by a downward movement and are demountable from said supporting member by an upward movement.

4. An apparatus according to claim 2, wherein said supporting member is movable in a horizontal direction in the state that said main assembly of said apparatus is set on a horizontal surface, wherein, in the state that supporting member is in the retracted position, said drum cartridges are mountable to said supporting member by a downward movement and are demountable from said supporting member by an upward movement, and wherein, in the state that supporting member is in the retracted position, said developing cartridges are detachably mountable in a direction that is along said supporting member and that is substantially perpendicular to the moving direction of said supporting member.

5. An apparatus according to claim 1 or 2, wherein the mounting and demounting directions of said drum cartridges and the mounting and demounting directions of said developing cartridges are substantially perpendicular to each other.

6. An apparatus according to claim 1, wherein sets each including one of said drum cartridges and one of said developing cartridges are demountably supported on said supporting member in a line.

7. An apparatus according to claim 6, further comprising a moving means for contacting and spacing between said electrophotographic photosensitive member drum and said developing roller in the state that said drum cartridges and said developing cartridges are supported by said supporting member, wherein said moving means spaces between said electrophotographic photosensitive member drum and said developing roller in a state in which said supporting member is in the retracted position.

8. An apparatus according to claim 1, further comprising a moving means for contacting and spacing between said electrophotographic photosensitive member drum and said developing roller in the state that said drum cartridges and said developing cartridges are supported by said supporting member, wherein said moving means spaces between said electrophotographic photosensitive member drum and said developing roller in a state in which said supporting member is in the retracted position.

9. An apparatus according to claim 8, further comprising control means for controlling an operation of said moving means in a state in which said supporting member is in the inside position.

10. An apparatus according to claim 1, wherein said supporting member includes first guides configured and positioned to guide said drum cartridges, respectively, and second guides configured and positioned to guide said developing cartridges, respectively.

* * * * *